US008385760B2

(12) United States Patent
Matsuda

(10) Patent No.: US 8,385,760 B2
(45) Date of Patent: Feb. 26, 2013

(54) IMAGE FORMING APPARATUS AND CONTROL DEVICE FOR IMAGE FORMING APPARATUS FOR DETECTING AND CANCELLING IMAGE EXPANSION AND CONTRACTION PATTERN

(75) Inventor: Hiromichi Matsuda, Isehara (JP)

(73) Assignee: Ricoh Company, Limited, Tokyo (JP)

( * ) Notice: Subject to any disclaimer, the term of this patent is extended or adjusted under 35 U.S.C. 154(b) by 337 days.

(21) Appl. No.: 12/805,108

(22) Filed: Jul. 13, 2010

(65) Prior Publication Data

US 2011/0013919 A1 Jan. 20, 2011

(30) Foreign Application Priority Data

Jul. 14, 2009 (JP) ..... 2009-165308

(51) Int. Cl.
*G03G 15/00* (2006.01)

(52) U.S. Cl. ..... 399/49

(58) Field of Classification Search ..... 399/46, 399/167, 49, 38
See application file for complete search history.

(56) References Cited

U.S. PATENT DOCUMENTS

| | | | | |
|---|---|---|---|---|
| 5,995,802 | A | 11/1999 | Mori et al. | |
| 2007/0172257 | A1 | 7/2007 | Matsuda et al. | |
| 2008/0013970 | A1 | 1/2008 | Kikuchi | |
| 2008/0013972 | A1 | 1/2008 | Matsuda | |
| 2008/0166153 | A1 * | 7/2008 | Ehara et al. | 399/167 |
| 2009/0052922 | A1 * | 2/2009 | Aoyagi | 399/66 |
| 2009/0238588 | A1 * | 9/2009 | Matsuda et al. | 399/46 |

FOREIGN PATENT DOCUMENTS

| | | |
|---|---|---|
| CN | 101008803 | 8/2007 |
| CN | 101097419 | 1/2008 |
| CN | 101105662 | 1/2008 |
| JP | 3186610 | 5/2001 |
| JP | 3564953 | 6/2004 |
| JP | 2007-226206 | 9/2007 |

OTHER PUBLICATIONS

Abstract of JP 10-078734 published Mar. 24, 1998.
Abstract of JP 10-186787 published on Jul. 14, 1998.
Office Action for corresponding Chinese patent application No. 201010230386.7 issued on Aug. 3, 2012.

* cited by examiner

*Primary Examiner* — Quana M Grainger
(74) *Attorney, Agent, or Firm* — Harness, Dickey & Pierce, P.L.C.

(57) ABSTRACT

In an image forming apparatus, a control device recognizes expansion and contraction of a pattern image based on an output of an image detector. The control device calculates a driving motor velocity fluctuation cancellation pattern for driving a common drive source. The driving motor velocity fluctuation cancellation pattern creates a latent image expansion and contraction cancellation pattern capable of canceling the expansion and contraction of the pattern image detected by the image detecting device. A process of obtaining the cancellation patterns is executed except when a print job for forming the toner image is executed in accordance with image information. The control device controls the common drive source in accordance with the cancellation driving motor pattern.

8 Claims, 13 Drawing Sheets

FIG. 19A

FIG. 19 | FIG. 19A | FIG. 19B | FIG. 19C

| | |
|---|---|
| FORMULA 1 | $V_{bT} = V_{b0} + \Delta V_b \cos(\omega_{b0} t + \alpha_b)$ |
| FORMULA 2 | $\delta P_0 = V_{bT} \delta t = \{V_{b0} + \Delta V_b \cos(\omega_{b0} t + \alpha_b)\} \delta t$ |
| FORMULA 3 | $V_{bD} = V_{b0} + \Delta V_b \cos(\omega_{b0} t + \alpha_b + \phi_d)$ |
| FORMULA 4 | $\delta P = \frac{\delta P_0}{V_{bD}} V_{b0} = P_n \frac{V_{b0} + \Delta V_b \cos(\omega_{b0} t + \alpha_b)}{V_{b0} + \Delta V_b \cos(\omega_{b0} t + \alpha_b + \phi_d)}$ |
| FORMULA 5 | $\delta P = P_n \frac{1}{V_{b0}} \{V_{b0} + \Delta V_b \cos(\omega_{b0} t + \alpha_b) - \Delta V_b \cos(\omega_{b0} t + \alpha_b + \phi_d)\}$ |
| FORMULA 6 | $\delta P = P_n \frac{1}{V_{b0}} \left\{V_{b0} + 2 \Delta V_b \sin\left(\frac{\phi_d}{2}\right) \sin\left(\omega_{b0} t + \alpha_b + \frac{\phi_d}{2}\right)\right\}$ |
| FORMULA 7 | $\Delta V_b : 2 \Delta V_b \sin\left(\frac{\phi_d}{2}\right)$ |
| FORMULA 8 | $\alpha_b : \alpha_b + \frac{\phi_d}{2} - \frac{\pi}{2}$ |
| FORMULA 9 | $\omega_m = \omega_{m0} + \Delta \omega_{m1} \cos(\omega_{m1} t + \alpha_{m1})$ |

FIG. 19B

| | |
|---|---|
| FORMULA 10 | $V_{dm} = R_d G_d \omega_m = R_d G_d \{\omega_{m0} + \Delta\omega_{m1} \cos(\omega_{m1} t + \alpha_{m1})\}$ |
| FORMULA 11 | $V_{bm} = R_b G_b \omega_m = R_b G_b \{\omega_{m0} + \Delta\omega_{m1} \cos(\omega_{m1} t + \alpha_{m1})\}$ |
| FORMULA 12 | $\delta P_{mS} = V_{dm} \delta_t = R_d G_d \{\omega_{m0} + \Delta\omega_{m1} \cos(\omega_{m1} t + \alpha_{m1})\} \delta t$ |
| FORMULA 13 | $\delta P_{mT} = \frac{V_{dm}}{V_{bm}} \delta P_{d0} = \frac{R_d G_d \{\omega_{m0} + \Delta\omega_{m1} \cos(\omega_{m1} t + \alpha_{m1})\}}{R_b G_b \{\omega_{m0} + \Delta\omega_{m1} \cos(\omega_{m1} t + \alpha_{m1})\}} \delta P_{d0}$ |
| FORMULA 14 | $\delta P_{mT} = \frac{R_d G_d}{R_b G_b} \frac{\delta P_{d0}}{\omega_{m0}} \{\omega_{m0} + \Delta\omega_{m1} \cos(\omega_{m1} t + \alpha_{m1}) - \Delta\omega_{m1} \cos(\omega_{m1} t + \alpha_{m1})\} = \frac{R_d G_d}{R_b G_b} \delta P_{d0}$ |
| FORMULA 15 | $P_{C_N} = \int_0^{TeN} \delta P_{dm} dt = \int_0^{TeN} R_d G_d \{\omega_{m0} + \Delta\omega_{m1} \cos(\omega_{m1} t + \alpha_{m1})\} dt$ |
| FORMULA 16 | $P_{C_N} = R_d G_d \omega_{m0} TeN + R_d G_d \frac{\Delta\omega_{m1}}{\omega_{m1}} \sin(\omega_{m1} TeN + \alpha_{m1}) + C$ |
| FORMULA 17 | $C = -R_d G_d \frac{\Delta\omega_{m1}}{\omega_{m1}} \sin(\alpha_{m1})$ |

FIG. 19C

| | |
|---|---|
| FORMULA 18 | $-A_{m1} = R_d G_d \frac{\Delta \omega_{m1}}{\omega_{m1}}$ |
| FORMULA 19 | $B_{m1} = \alpha_{m1}$ |
| FORMULA 20 | $P_{r_}N = P_{C_}N - P_{C_}N-1$ <br> $= R_d G_d \omega_{m1} Te + R_d G_d \frac{\Delta \omega_{m1}}{\omega_{m1}} \{\sin(\omega_{m1} TeN + \alpha_{m1}) - \sin(\omega_{m1} Te(N-1) + \alpha_{m1})\}$ |
| FORMULA 21 | $P_{r_}N = R_d G_d \omega_{m1} Te - 2R_d G_d \frac{\Delta \omega_{m1}}{\omega_{m1}} \sin\left(\frac{\omega_{m1} Te}{2}\right) \cos\left(\omega_{m1} TeN + \alpha_{m1} - \frac{\omega_{m1} Te}{2}\right)$ |
| FORMULA 22 | $-A'_{m1} = -2R_d G_d \frac{\Delta \omega_{m1}}{\omega_{m1}} \sin\left(\frac{\omega_{m1} Te}{2}\right)$ |
| FORMULA 23 | $B_{m1} = \alpha_{m1} - \frac{\omega_{m1} Te}{2}$ |

IMAGE FORMING APPARATUS AND CONTROL DEVICE FOR IMAGE FORMING APPARATUS FOR DETECTING AND CANCELLING IMAGE EXPANSION AND CONTRACTION PATTERN

CROSS-REFERENCE TO RELATED APPLICATIONS

This application claims priority under 35 USC §119 to Japanese Patent Application No. 2009-165308, filed on Jul. 14, 2009, the entire contents of which are herein incorporated by reference.

BACKGROUND OF THE INVENTION

1. Field of the Invention

The present invention relates to image forming apparatuses, such as a copier, a facsimile, a printer, etc., that transfer an image visualized on a surface of a latent image bearer onto a transfer member.

2. Discussion of the Background Art

In a well known image forming apparatus, a toner image is formed on a surface of a drum state photoconductive member that serves as a latent image bearer and is transferred onto an endless belt that serves as a transfer member. Such a belt member is generally wound around plural rollers and is rotated as one of the plural rollers is driven and rotates. When a driving force relay gear secured to a rotational supporting shaft of the photoconductive member includes eccentricity, a velocity of the photoconductive member fluctuates in one cycle showing a sine curve per rotation thereof. As a result, a latent image is written on the photoconductive member either expanded or contracted from an original shape. A toner image is then similarly transferred onto the belt member. As a result, the image shape is distorted.

Then, a conventional image forming apparatus attempts to suppress such image distortion using a prescribed method as discussed in Japanese Patent Registration No. 3186610.

Specifically, a motor commonly drives both of a photoconductive member and a driving roll while finely adjusting a driving velocity of the motor. However, the velocity of not only the photoconductive member but also the belt member necessarily fluctuates. Specifically even though the velocity fluctuation of the photoconductive member is suppressed by a certain degree, the velocity fluctuation of the belt remains and causes new image distortion. Therefore, it has been believed difficult to drive both the photoconductive member and the belt member with one common motor by simply finely adjusting the driving velocity thereof.

SUMMARY OF THE INVENTION

Accordingly, an object of the present invention is to address and resolve such and other problems and provide a new and novel image forming apparatus. Such a new and novel image forming apparatus includes an information reception device that receives image information, a latent image bearer that rotates and bears a latent image, and a latent image writing device that writes the latent image at a prescribed latent image writing position on the surface of the latent image bearer in accordance with the image information.

A developing device is provided to develop the latent image and obtain a toner image on the surface. A transfer device is provided to transfer the toner image onto a transfer receiving member at a prescribed transfer position. A conveyance device is provided to convey the transfer receiving member in the same direction as the latent image bearer moves at the prescribed transfer position. An image detector is provided to detect expansion and contraction of a pattern image formed and transferred onto the transfer receiving member at a pattern image detection position. A driving source is provided to provide a driving force.

A common drive force transmission system is provided to transmit the driving force to the image bearer and the conveyance device. The common drive transmission system includes a transmission member. A rotational position detector is provided to detect a rotational position of the transmission member. The transmission member causes fluctuation of a velocity of one of the latent image bearer and the transfer receiving member in a cycle of its rotation. A control device is provided to control formation of the pattern image while driving the common drive source at a prescribed velocity. The control device recognizes expansion and contraction of the pattern image based on an output of the image detector. The control device obtains a driving motor velocity fluctuation cancellation pattern for driving the common drive source.

The driving motor velocity fluctuation cancellation pattern creates a latent image expansion and contraction cancellation pattern capable of canceling, at the prescribed latent image writing position, the expansion and contraction of the pattern image detected by the image detecting device. A process of obtaining the cancellation patterns is executed except when a print job for forming the toner image is executed in accordance with the image information. The control device controls the common drive source in accordance with the driving motor velocity fluctuation cancellation pattern.

In another aspect of the present invention, the latent image expansion and contraction cancellation pattern includes the same amplitude and an opposite phase to the expansion and contraction of the pattern image detected by the image detector.

In yet another aspect of the present invention, the latent image bearer has a cylindrical shape. The transmission member rotates around an axis of the latent image bearer and transmits the driving force thereto. The transmission member causes the fluctuation of a velocity of the latent image bearer.

In yet another aspect of the present invention, the transfer member includes an endless belt winding and traveling around the transmission member as the transmission member rotates. The conveyance device conveys one of the endless belt and a printing member carried on the endless belt. The transmission member causes the fluctuation of a velocity of the endless belt.

In yet another aspect of the present invention, the pattern image is generated on the endless belt in one rotational cycle thereof.

In yet another aspect of the present invention, plural latent image bearers are aligned in a transfer member conveyance direction. Plural transfer devices transfer and superimpose visualized plural images on the transfer receiving member. The common driving force transmission system transmits the driving force to all of the plural latent image bearers. Phases of velocity fluctuation of the plural latent image bearers are equalized with each other.

In yet another aspect of the present invention, a detection error correcting device corrects an error of expansion and contraction pattern detection. The error is caused by fluctuation of a conveyance velocity of the transfer receiving member at the pattern image detection position.

In yet another aspect of the present invention, the transmission member includes a driven roller that supports the endless belt. The supporting driven roller is driven and rotated by the endless belt as the endless belt rotates. The driven roller causes fluctuation of the endless belt in a rotation cycle thereof.

In yet another aspect of the present invention, the pattern image includes plural patches aligned on the latent image bearer surface moving direction. The image detector is enabled to detect an interval between the plural patches.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIGS. 19A to 19C collectively illustrate exemplary formulas used in various embodiments to calculate a prescribed velocity fluctuation pattern of the common motor.

DESCRIPTION OF THE PREFERRED EMBODIMENTS

Figure 1:
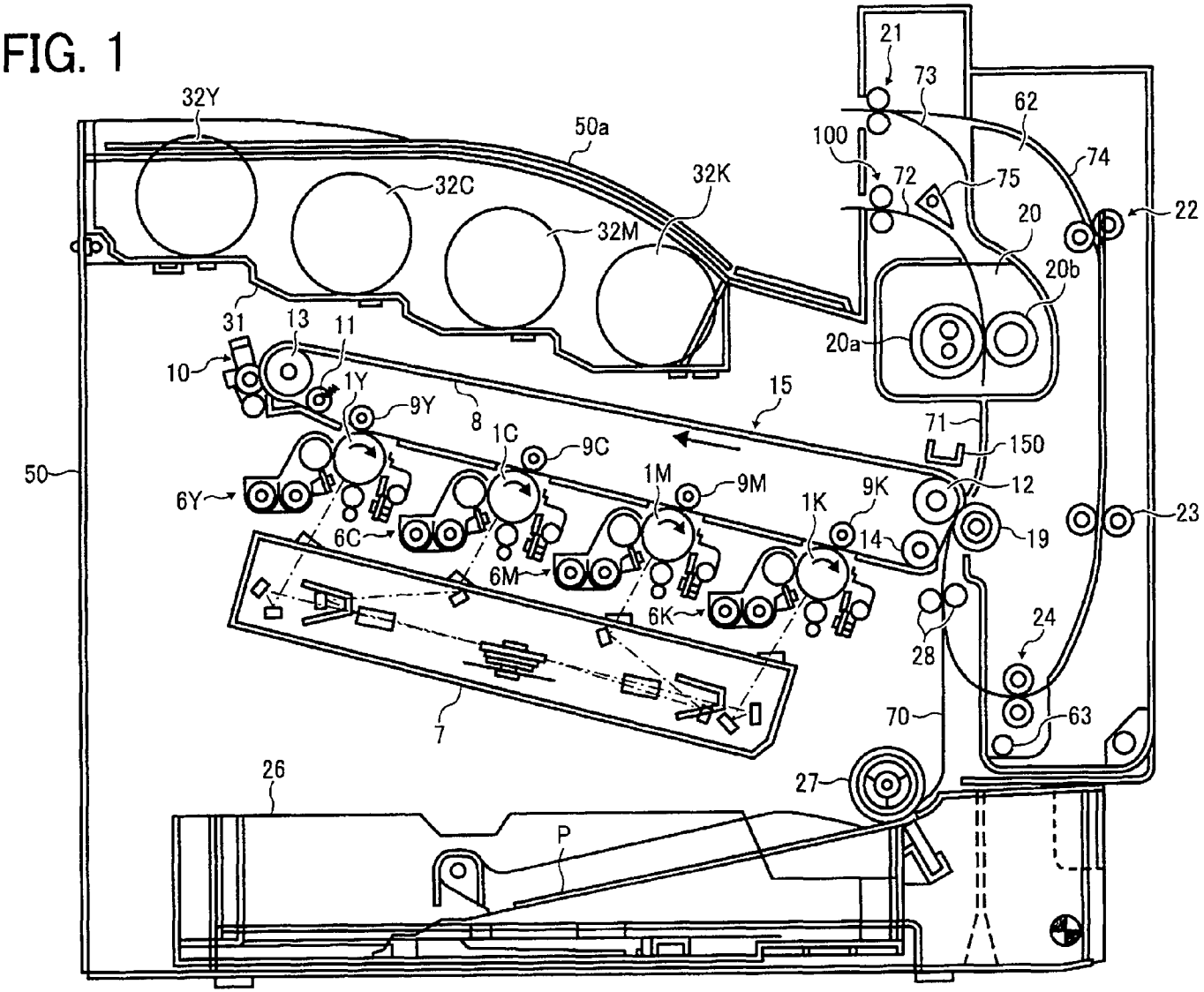
FIG. 1 illustrates an exemplary printer according to one embodiment of the present invention.

Referring now to the drawings, wherein like reference numerals and marks designate identical or corresponding parts throughout several figures. An exemplary electro photographic printer as an image forming apparatus to which the present invention is applied is specifically described.

Initially, investigation executed by the applicants into a relation between a velocity fluctuation of a photoconductive member and expansion and contraction of an image is described.

Figure 12:
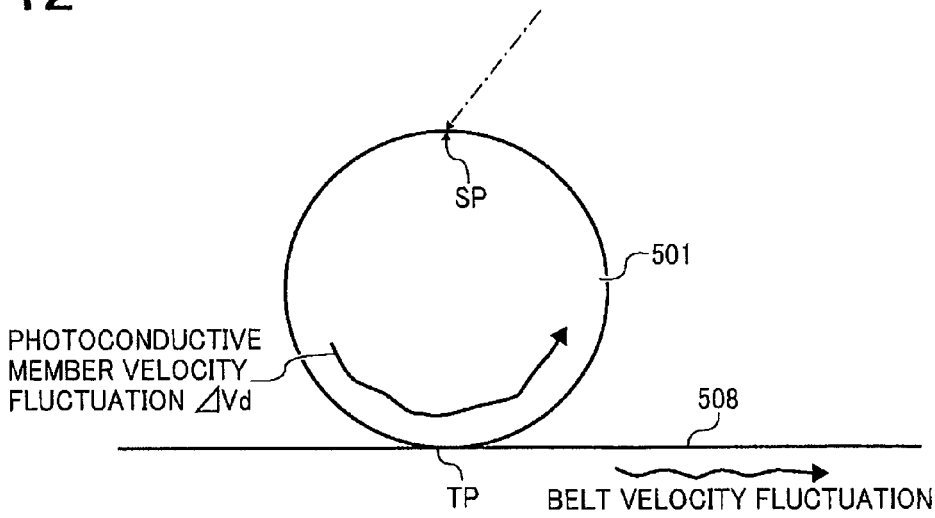
FIG. 12 illustrates an exemplary photoconductive member and its surroundings according to one embodiment of the present invention.

Specifically, it is revealed that even if one motor drives both the photoconductive member and the belt member while driving velocity of the motor is simply finely adjusted as shown in FIG. 12, image distortion can still be suppressed. Specifically, as shown, a drum state photoconductive member 501 is driven and is rotated by a driving device, not shown, counter clockwise in the drawing. A laser light L for optical writing use is emitted at an exposure point SP of a prescribed rotation position and thereby a latent image is written onto a surface of the photoconductive member 501. The latent image is developed to be a toner image when passing through a developing device, not shown, as the photoconductive member 501 rotates. The toner image enters a transfer point TP and is transferred onto the intermediate transfer belt 508 where the photo-conductive member 501 contacts an intermediate transfer belt 508 as the photo-conductive member 501 rotates. Now, a system is described on condition that the exposure and transfer points are symmetrical with reference to a point by 180 degree for the purpose of easier comprehension.

Figure 13:
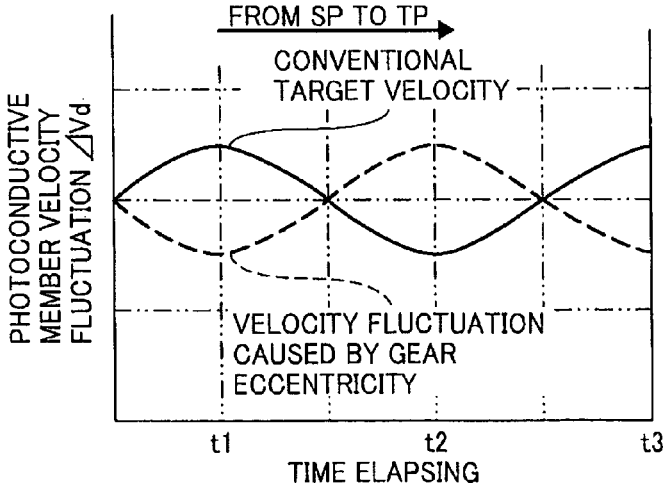
FIG. 13 graphically illustrates an exemplary velocity fluctuation pattern of the photoconductive member caused by eccentricity of the photoconductive member gear according to one embodiment of the present invention.
Figure 14:
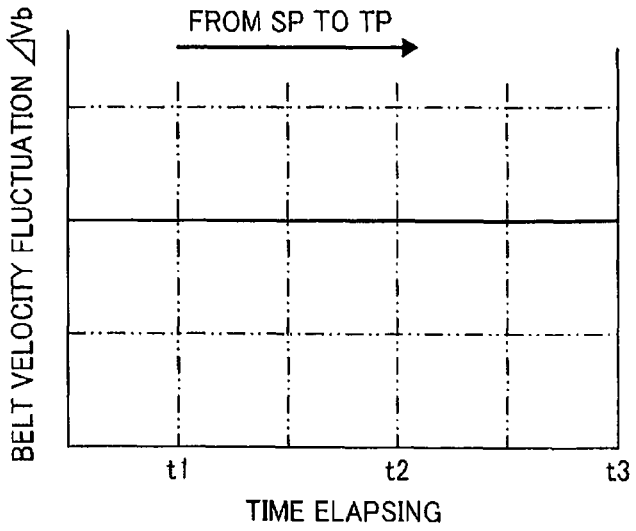
FIG. 14 illustrates exemplary structures of the main control and drive control sections of FIG. 6 according to one embodiment of the present invention.

It is hereinafter premised that an eccentricity cam is used as a photoconductive member gear, not shown, secured to a rotation shaft of the photoconductive member 501. A motor that drives the photoconductive member 501 is private use, and is separated from a motor that drives the intermediate transfer belt 508. The photoconductive member use motor is driven at a uniform velocity. Owing to the eccentricity of the gear, velocity fluctuation of the photoconductive member 501 showing one cycle of a sine curve appears per rotation of the photoconductive member 501 as shown in FIG. 13. At this moment, however, the velocity of the intermediate transfer belt 8 driven by the separate motor is constant as shown in FIG. 14.

At the time point t1 corresponding to the lower side peak of the sine curve of FIG. 13, the latent image written at the exposure point SP contracts than its original in the photoconductive member surface moving direction. The latent image is then developed by the developing device to be a toner image, and enters a transfer point TP at the time point t2. The toner image is then transferred from the photoconductive member 501 onto the intermediate transfer belt 508. At this moment, the velocity of the photoconductive member 501 corresponds to the upper side peak of the sine curve as shown in FIG. 13. Since the velocity of the intermediate transfer belt 8, however, is stable substantially at a target level regardless of the rotation angle of the photoconductive member 501 as shown in FIG. 14, the line velocity of the photoconductive member 501 becomes greater than that of the belt at the time point t2 of FIG. 13. Then, the toner image on the photo-conductive member 501 contracts than before in the belt surface moving direction and is transferred onto the intermediate transfer belt 8. Thus, the image contracts both at the exposure and transfer points SP and TP, respectively. Different from the image written at the time point t1, the image written at the time point t2 expands at both of the exposure and transfer points SP and TP at the time points t2 and t3, respectively. Thus, when the velocity of the photoconductive member 501 fluctuates due to the eccentricity of the photoconductive member gear, the image expands or contracts at the exposure and transfer points SP and TP, respectively.

Then, in the conventional image forming apparatus, a driving velocity of a motor that drives a photo-conductive member 501 is finely adjusted to a conventional target velocity that is obtained by reversing that of the photo-conductive member as shown in FIG. 13 to decrease the sine curve state velocity fluctuation and suppress the image expansion and contraction at the exposure and transfer points SP and TP, respectively, as far as possible.

In contrast, according to one embodiment of the present invention, it is attempted that a velocity of a photo-conductive member 501 is intentionally fluctuated rather than suppressing the same as mentioned below more in detail.

Figure 15:
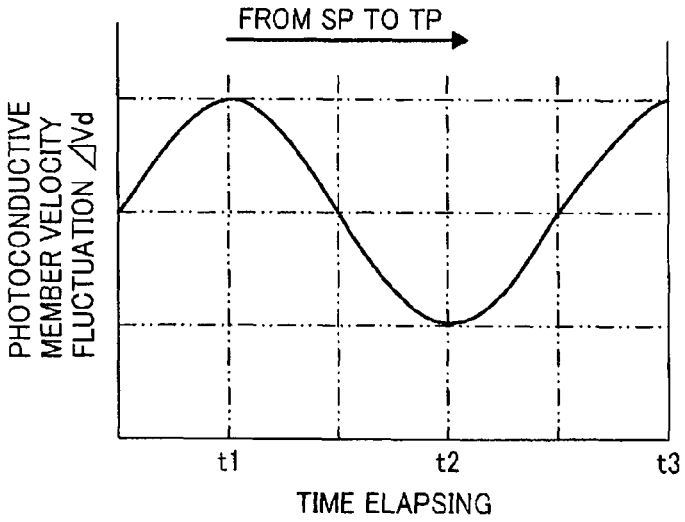
FIG. 15 graphically illustrates an exemplary velocity fluctuation pattern of the photoconductive member when driving of a common motor is controlled according to one embodiment of the present invention.
Figure 16:
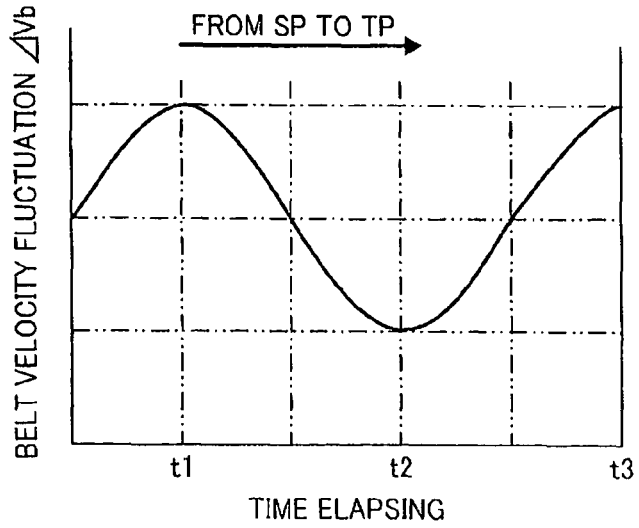
FIG. 16 graphically illustrates an exemplary velocity fluctuation pattern of the intermediate transfer belt when driving of a common motor is controlled according to one embodiment of the present invention.

Specifically, it is supposed that a photoconductive member gear is used, which is expensive and is obtained by applying highly precise processing to avoid eccentricity thereof. Further supposed is that, a motor, not shown, that drives and rotates the photoconductive member 501, is also used as a driving source for the intermediate transfer belt 508. In such a situation, it is also supposed that, the driving velocity of the common motor is fluctuated for a reason other than the eccentricity of the photo-conductive member gear, and thereby similar velocity fluctuation is intentionally caused on each of the photo-conductive member 501 and the intermediate transfer belt 8 as shown in FIGS. 15 and 16. Since the common motor drives both of the photoconductive member 501 and the intermediate transfer belt 8, velocity fluctuation having the same amplitude and phase with each other appears on the photoconductive member 501 and the intermediate transfer belt 8.

At the time point t1 of the upper side peak of the sine curve of FIG. 15, the latent image written at the exposure point SP expands than its original shape in the photoconductive member surface moving direction. The latent image is then developed to be a toner image and enters a transfer point TP at the time point t2. The toner image is then transferred from the photoconductive member 501 onto the intermediate transfer belt 508. At this moment, the velocity of the photoconductive member 501 corresponds to the lower side peak of the sine curve as shown in FIG. 15. At this moment, the velocity of the intermediate transfer belt 8 corresponds to the lower side peak of the sine curve as shown in FIG. 16. Thus, the line velocity of the photoconductive member 501 is not different from that of the intermediate transfer belt 508 at the time point t2. Thus, the toner image on the photo-conductive member 501 neither expands nor contracts in the belt surface moving direction and is transferred onto the intermediate transfer belt 8 as is at the transfer point TP. In this way, even if the velocity of the photo-conductive member 501 is intentionally fluctuated by controlling driving of the common motor, the image does not expand or contract at the transfer point TP, different from the velocity fluctuation of the photo-conductive member 501 caused by the eccentricity of the photo-conductive member gear. Specifically, the image expansion and contraction caused by the driving control of the common motor only appears at the exposure point SP.

Further, at the time point t1 in FIG. 15, driving control of the common motor is executed so that a velocity is increased and amplitude of the sine curve becomes twice as large as the conventional target level. As a result, at the exposure point SP, a latent image is written expanded twice as large as the original. At this moment, a velocity of the photoconductive member 501 is also increased at the transfer point TP to amplitude of the sine curve twice as large as that of the conventional target level. However, since a velocity of the intermediate transfer belt 508 also increases by the same amount, a difference of line velocity is not caused between the photoconductive member and the belt 508. Thus, the image neither expands nor contracts owing to the driving control of the common motor, at the transfer point TP. Specifically, the contraction of an image caused by the eccentricity of the photo-conductive member gear at the both sections of the exposure and transfer points SP and TP can be cancelled by expanding and writing the latent image to have a twice size only at the exposure point SP.

Thus, as already mentioned above, the expansion and contraction of the image caused due to eccentricity of the photoconductive member gear includes superimposition of those appearing at the both exposure and transfer points SP and TP. An image expansion and contraction pattern of an image finally appearing on a belt as a result of such superimposition can be recognized based on a detection result of a sensor that detects the pattern image. Then, by expecting an occurrence of such an image expansion and contraction pattern and controlling driving of a common motor by using a velocity fluctuation pattern capable of generating a latent image expansion and contraction pattern having an opposite phase to the above-mentioned expansion and contraction pattern at an exposure point SP, the image expansion and contraction pattern can be cancelled by the latent image expansion and contraction pattern. As shown in FIG. 12, when the exposure and transfer points SP and TP are arranged at a 180 degree phase angle with each other, the common motor is preferably controlled using a driving velocity pattern capable of generating a velocity fluctuation pattern as shown by a dotted line in FIG. 17.

Figure 17:
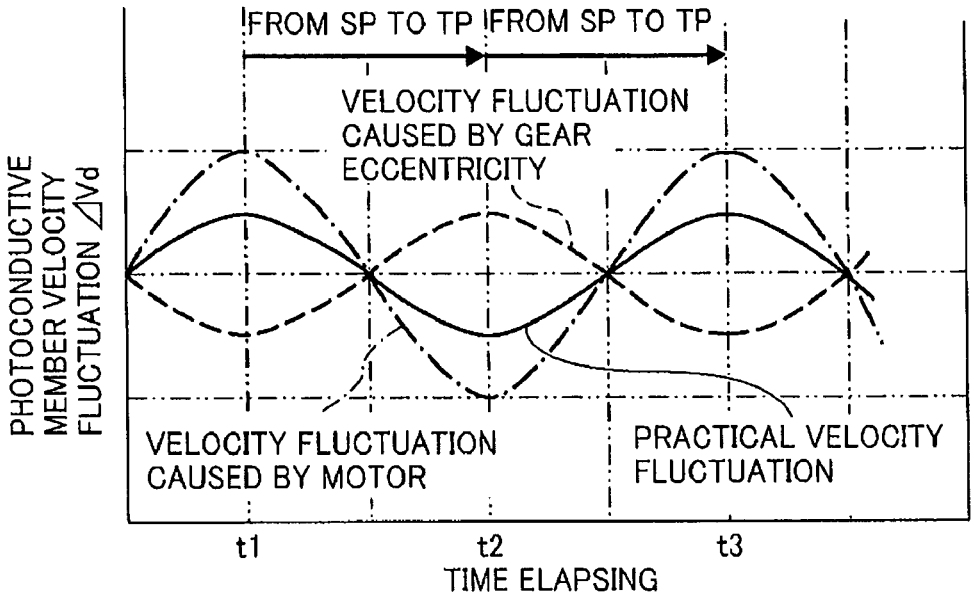
FIG. 17 graphically illustrates an exemplary velocity fluctuation pattern of the photoconductive member caused by eccentricity of the photoconductive member gear, that caused when driving of a common motor is controlled, and that practically appears according to one embodiment of the present invention.
Figure 18:
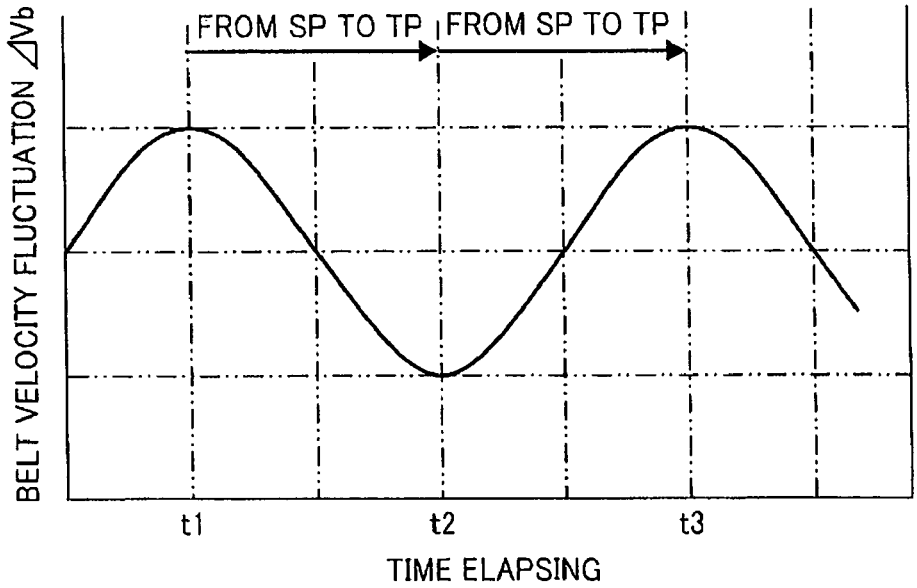
FIG. 18 graphically illustrates an exemplary velocity fluctuation pattern of the intermediate transfer belt when driving of the common drive motor of FIG. 17 is controlled according to one embodiment of the present invention.

Specifically, driving control is executed to generate a velocity fluctuation pattern having an opposite phase with amplitude twice as large as that to suppress the velocity fluctuation pattern appearing on the photoconductive member 501 due to the eccentricity of the photoconductive member gear. As a result, the velocity fluctuation pattern practically appearing on the photoconductive member, as shown by a solid line in the drawing, is composed of superimposition of the velocity fluctuation pattern caused by the eccentricity of the photoconductive member gear (i.e., a dotted line) and that caused by the above-mentioned driving control of the common motor (i.e., an alternate long and short dash line). Thus, as shown, the pattern includes an opposite phase and the same amplitude as the velocity fluctuation pattern that appears on the photoconductive member caused by the eccentricity of the photoconductive member gear. At this moment, as shown in FIG. 18, the same velocity fluctuation pattern appears on the intermediate transfer belt 508 as the velocity fluctuation pattern appearing on the photo-conductive member caused by the driving control of the common motor. As shown in FIG. 17, since the solid line graph shows an upper side peak at the time point t1, a latent image written at the exposure point SP is expanded more than its original. Then, the latent image is developed by the developing device to be a toner image and enters the transfer point TP at the time point t2. Whereas the velocity of the intermediate transfer belt at the time point t2 is brought into the lower peak having a wave height twice as large as that of the solid line of FIG. 17 as shown in FIG. 18. Thus, the intermediate transfer belt moves slower than the photoconductive member at the time point t2, and a difference of the line velocity is equal to the wave height of the velocity fluctuation pattern of the photoconductive member. Thus, with such a line velocity difference at the transfer point TP, the toner image contracts by the same amount as that of expansion appearing on the latent image at the previous exposure point SP and is transferred onto the intermediate transfer belt. Thus, expansion appearing on the latent image at the previous exposure point SP is cancelled by the toner image contraction caused at the transfer point TP, and the toner image on the intermediate transfer belt has a correct size without expansion and contraction. In this way, by using an expansion and contraction latent image pattern generated by controlling driving of the common motor at the exposure point SP, the image expansion and contraction pattern necessarily created by eccentricity of the photo-conductive member gear can be cancelled.

Specifically, since the image is expanded and contracts at the exposure and transfer points SP and TP with the 180 degree phase angle relation, in the system, respectively as shown in FIG. 12, the image expansion and contraction pattern appearing on an image on a belt includes the amplitude twice as large and the same phase as a velocity fluctuation pattern of the photo-conductive member which is caused by the eccentricity of the photo-conductive member gear as shown in FIG. 15. To cancel such an image expansion and contraction pattern, substantially all to do is to generate an expansion and contraction pattern of a latent image having the same amplitude and an opposite phase to that of the image expansion and contraction pattern at the exposure point SP. Thus, as shown in FIG. 17, a velocity fluctuation pattern having the amplitude twice as large and an opposite phase to that appearing on the photo-conductive member due to the eccentricity of the photo-conductive member gear is generated by controlling driving of the common motor. When the phase angle between the exposure and transfer points SP and TP is changed from 180 degree, image expansion and contraction pattern appearing on the image on the belt becomes different. For example, when the phase angle is 90 degree, an image expansion and contraction pattern appearing on the image on the belt includes amplitude of 7/10 times of that generated when the phase angle is 180 degree. A phase of the pattern is delayed by 45 degree from the velocity fluctuation pattern of the photoconductive member. To generate an expansion and contraction pattern of a latent image capable of canceling such an image expansion and contraction pattern at the exposure point SP, substantially all to do is to generate a velocity fluctuation pattern capable of generating an image expansion and contraction pattern having the same amplitude with an opposite phase to that generated by the eccentricity of the photoconductive member gear at the exposure point SP by controlling driving of the common motor. Every when the above-mentioned phase angle is set to any level, an image expansion and contraction pattern appearing on the image on the belt caused by the eccentricity of the photoconductive member gear has a performance showing one cycle of a sine curve per rotation of the photoconductive member.

Further, a driving velocity fluctuation pattern of the common motor for generating a latent image expansion and contraction pattern capable of canceling the image expansion and contraction pattern also has a performance that shows one cycle of a sine curve per rotation of the photoconductive member.

In addition to the above, the image distortion is also created by velocity fluctuation of a belt member. For example, if a driving roller that drives the belt member is eccentric, a velocity of the belt member fluctuates and an image expansion and contraction pattern appears showing one cycle of a sine curve per rotation of the driving roller.

Further, when a belt member is produced using a centrifugal molding, due to eccentricity of the mold during molding, a thickness uneven pattern of a sine curve having a cycle per circulation of a belt appears in a belt circumferential direction. As a result, a velocity fluctuation in a sine circa state having a cycle per circulation of the belt occurs on the belt member, and accordingly, an image expansion and contraction pattern in a sine curve state occurs.

These image expansion and contraction pattern is caused independent from velocity fluctuation of the photoconductive member at the latent image writing position, and is caused only depending on a difference of a line velocity between a photo-conductive member and the belt member at the transfer position.

Such an image expansion and contraction pattern can be cancelled by finely adjusting a driving velocity of a common motor so that a latent image expansion and contraction pattern having an opposite phase to that is generated at an exposure point SP.

Specifically, image distortion caused by the belt member velocity fluctuation can also be cancelled if a driving velocity of a common motor that drives both of the photoconductive member and the belt member is finely adjusted.

Figure 2:
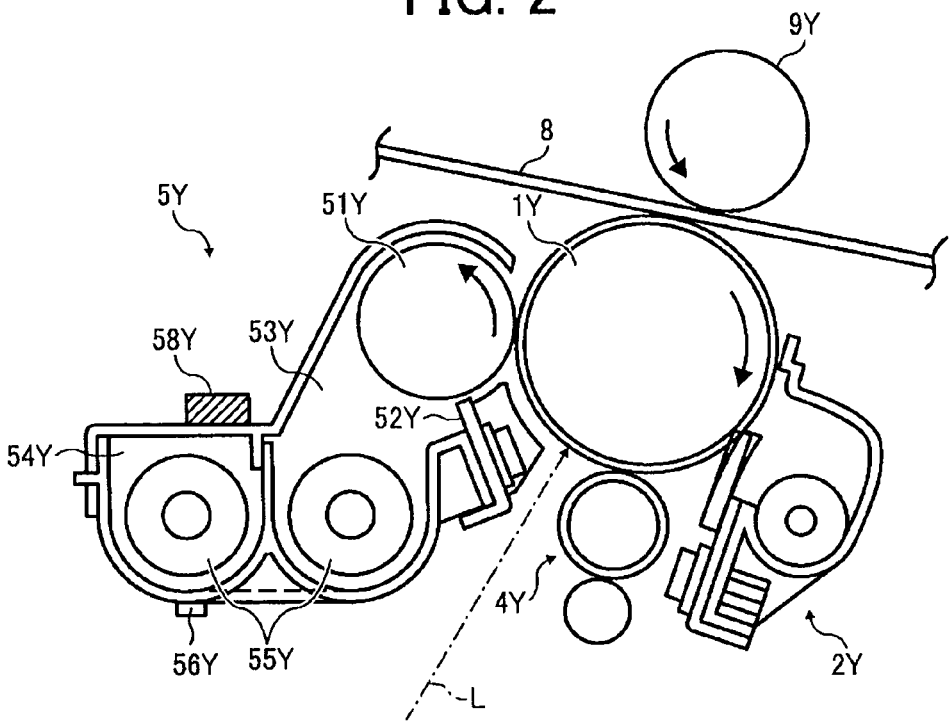
FIG. 2 illustrates an exemplary process unit for Y component color use included in the printer of FIG. 1.

Now, an exemplary electrophotographic printer as an image forming apparatus to which the present invention is applied is specifically described with reference to FIG. 1. As shown, the printer includes four process units 6Y to 6K which form toner images of yellow, cyan, magenta, and black component colors (hereinafter referred to Y to K), respectively. These process units have substantially the same construction with each other and are separately replaced with new ones when arriving at its end of life. Now, the process unit 6Y for forming a Y-toner image is typically described with reference to FIG. 2. As shown, the process unit 6Y includes a drum state photo-conductive member 1Y as a latent image bearing member, a drum cleaning device 2Y, a charge removing device, not shown, a charge device 4Y, and a developing device 5Y or the like. The process unit 6Y is detachable to a printer body and is capable of replacing used up parts with new ones at once.

The charge device 4Y uniformly charges the surface of the photoconductive member 1Y rotated clockwise in the drawing by a driving device, not shown. The surface of the photoconductive member 1Y is then subjected to exposure scanning of a laser light L and thereby bearing a Y-use latent image. The Y-use latent image is then developed by a developing device 5Y using Y developer including Y toner and carrier to be the Y-toner image. Then, the Y-toner image is temporarily transferred onto an intermediate transfer belt 8 as a belt member as mentioned later in detail. The drum cleaning device 2Y removes toner remaining on the surface of the photoconductive member 1Y after the above-mentioned intermediate process. The charge-removing device removes electric charge remaining on the surface of the photoconductive member 1Y after the above-mentioned cleaning process. Thus, the surface of the photoconductive member 1Y is initialized and prepares for the next image formation. The toner image formations and intermediate transfer processes are similarly executed as mentioned above in the other process units 6C to 6K, respectively.

The developing device 5Y includes a developing roll 51Y partially protruding from an opening formed on a casing of the developing device 5Y. Further included are plural conveyance screws 55Y arranged in parallel to each other, a doctor blade 52Y, and a toner density sensor (herein after referred to as a T-sensor) 56Y.

Y developer, not shown, including magnetic carrier and Y toner is installed in the casing of the developing device 5Y. The Y developer is stirred and conveyed by a pair of conveyance screws and receives friction charge therefrom. The Y developer is then carried on the surface of the developing roll 51Y. Then, the doctor blade 52Y smoothes the developer in a prescribed thickness on the surface. The developer is then conveyed to a developing region opposing the Y use photoconductive member 1Y. The Y toner is attracted to the latent image on the photoconductive member 1Y and forms a Y toner image thereon. The Y developer having consumed the Y toner in development is returned to the casing of the developing device 5Y as the developing roll 51Y rotates.

A partition wall is arranged between the two conveyance screws, whereby first and second supply sections 53Y and 54Y are formed. The first supply section 53Y contains the developing roll 51Y and the right side conveyance screw 55Y in the drawing, while the second supply section 55Y contains the left side conveyance screw 55Y in the drawing. The right side conveyance screw 55Y is driven rotated by a driving device, not shown, and supplies the Y developer stored in the first supply section 53Y to the developing roll 51Y by conveying the same from front to rear sides in the drawing. The Y developer conveyed to the vicinity of the end of the first supply section 53Y by the right side conveyance screw 55Y enters the second supply section 54Y through an opening, not shown, formed on the partition wall.

The left side conveyance screw 55Y is driven rotated by a driving device, not shown, and conveys the Y developer conveyed from the first supply section 53Y in a direction different from that the right side screw 55Y conveys. The Y developer conveyed adjacent to the end of the second supply section 54Y by the left side conveyance screw 55Y returns to the first supply section 53Y through another opening, not shown, formed on the partition wall.

The T sensor 56Y is a magnetic permeability type and attached to a bottom wall of the second supply section 54Y to output a voltage in accordance with magnetic permeability of the Y developer that passes through overhead thereof. Since the magnetic permeability of the two-component developer including toner and magnetic carrier and toner density are finely correlated to each other, the T sensor 56Y can output a voltage in accordance with the density of the Y toner. The output voltage is then transmitted to a control section, not shown. The control section includes a RAM that stores Y use Vref information serving as a target to be reached by the output voltage transmitted from the T sensor 56Y. The RAM also includes C to K use Vref information pieces serving as targets to be reached by the output voltages transmitted from T sensors 56Y. The Y use Vref is used to control driving of the toner conveyance device for Y use, not shown, as mentioned later in detail. Specifically, the above-mentioned control section controls driving of the toner conveyance device for Y use to supply Y toner into the second supply section 54Y by controlling the output voltage from the T sensor 56Y to approach the Y use Vref. With this replenishment, the Y toner density of the Y developer in the developing device 5Y can be maintained within a prescribed range. In the rest of the developing devices in the other process units, the C to K use toner conveyance devices similarly replenishes toner.

Back to FIG. 1, below the process units 6Y to 6K, there is provided an optical writing unit 7 serving as a latent image writing device.

The optical writing unit emits a laser light L generated in accordance with image information to the photo-conductive members of the respective process units to execute exposure processes. Thus, latent images for Y to K uses are formed on the respective photoconductive members 1Y to 1K. The optical writing unit 7 emits the laser light L generated by a light source while scanning the laser light L with a polygon mirror that is driven rotated by a motor, not shown, to the photoconductive members via plural optical lenses and mirrors.

Below the optical writing unit 7 in the drawing, there is provided a sheet containing device having a sheet containing cassette 26 and a sheet feeding roller 27 or the like. The sheet-containing cassette 26 accommodates plural printing sheets P in a sheet state printing member. The sheet-feeding roller 27 contacts the upper most printing sheet P. When the sheet feeding roller 27 is rotated counter clockwise by a driving device, not shown, the upper most printing sheet P is launched toward a sheet-feeding path 70.

In the vicinity of the end of the sheet-feeding path 70, a registration roller pair 28 is arranged. Each of the registration roller pair 28 rotates to pinch the printing sheet P, and stops immediately thereafter. Then, the registration roller pair lunches the printing sheet P at an appropriate time toward a secondary transfer nip mentioned later in detail.

Above the process units 6Y to 6K, there is provided a transfer unit 15 that endlessly suspends and moves an intermediate transfer belt 8 as a transfer device. The transfer unit 15 includes a secondary transfer bias roller 19 and a belt cleaning device or the like beside the intermediate transfer belt 8.

Further included are four primary transfer bias rollers 9Y to 9K, a driving roller 12, a cleaning backup roller 13, a driven roller 14, and a tension roller 11 or the like. The intermediate transfer belt 8 is suspended by these rollers and is endlessly moved counter clockwise as the driving roller 12 rotates. The primary transfer bias rollers 9Y to 9K sandwiches the intermediate transfer belt 8 with the respective photoconductive members and forms primary transfer nips therebetween. A transfer bias having a prescribed polarity (e.g. negative) opposite to that of toner is applied to a backside surface (i.e., a loop inner circumferential surface) of the intermediate transfer belt 8. Thus, the rollers other than the primary transfer bias rollers 9Y to 9K are electrically grounded.

The intermediate transfer belt 8 executes a primary transfer process by receiving and superimposing respective toner images from the photo-conductive members when subsequently passing through the Y to K use primary transfer nips as its endlessly moves. Thus, a toner image of superimposing of four component colors (herein after referred to as a four color toner image) is formed on the intermediate transfer belt 8.

The driving roller 12 as a driving rotation member sandwiches the intermediate transfer belt 8 with the secondary transfer roller 19 and forms a secondary transfer nip therebetween.

The full-color toner image on the intermediate transfer belt 8 is transferred onto the printing sheet P at the secondary transfer nip, whereby becoming a full-color toner image in contrast with a white background on the printing sheet P. After the secondary transfer process, toner not transferred onto the printing sheet P remains on the intermediate transfer belt 8, and is removed by the belt-cleaning device 10. The printing sheet P having been subjected to the secondary transfer process is then conveyed to the fixing device 20 via a post transfer conveyance path.

In the fixing device 20, a fixing roller 20*a* having a heat source, such as a halogen lamp, etc., and a pressing roller 20*b* that rotates pressure contacting the fixing roller 20*a* at a prescribed pressure cooperatively form a fixing nip. The printing sheet P launched into the fixing device 20 is pinched by the fixing nip with its non-fixed toner image-bearing surface tightly contacting the fixing roller 20*a*. Then, with heat and pressure, toner in the toner image is softened, and a full color image is fixed.

The printing sheet P is then launched from the fixing device 20 and approaches to a bifurcation point of an ejection path 72 and a pre-reverse conveyance path 73. At the bifurcation point, there is provided a swingably arranged first switching pick 75 that swings and switches a track of the printing sheet P. Specifically, by moving a leading end of the pick in a direction to approach the pre-reverse conveyance path 73, the track of the printing sheet P is directed toward the sheet ejection path 72. In contrast, by moving the leading end in a direction to deviate from the pre-reverse conveyance path 73, the track is directed to the pre-reverse conveyance path 73.

When the track toward the sheet ejection path 72 is selected by the first switching pick 75, the printing sheet P passes through from the sheet ejection path 72 to a sheet ejection roller pair 100 and is ejected outside the apparatus body. The printing sheet P is then stacked on a stack 50*a* arranged on the upper surface of the printer casing. In contrast, when the track toward the pre-reverse conveyance path 73 is selected by the switching pick 75, the printing sheet P enters a nip of the reverse roller pair 21 via the pre-reverse conveyance path 73. The reverse roller pair 21 conveys the expansion and contraction pattern pinched between the rollers toward the stack section 50*a*. However, the roller is reversely rotated just before the trailing end of the printing sheet P enters the nip. Due to this reverse rotation, the printing sheet P is reversely conveyed than before, and the trail end of the printing sheet P enters the reverse conveyance path 74.

The reverse conveyance path 74 vertically extends while curving from upside to downside, and includes first to third reverse conveyance roller pairs 22 to 24 therein. Thus, the printing sheet P is upside down when conveyed through the nips between these roller pairs sequentially. The printing sheet P after being upside down returns to the above-mentioned sheet-feeding path 70, and arrives at the secondary transfer nip again. Then, the printing sheet P enters the secondary transfer nip with its non-image bearing surface tightly contacting the intermediate transfer belt 8, and whereby second four color toner image on the intermediate transfer belt 8 is secondary transferred onto the non-image bearing surface. Then, the printing sheet P passes through the post transfer conveyance path 71, the fixing device 20, the sheet ejection path 72, and the sheet ejection roller pair 100, and is then stacked on the stack section 50*a* of the outside.

In this way, the full-color image is formed on both side surfaces of the printing sheet P during the reverse conveyance.

A bottle supporting sec 31 is arranged between the transfer unit 15 and the stack section 50*a* arranged above the transfer unit 15. The bottle supporting section 31 holds toner bottles 32Y to 32K for storing Y to T toner. The toner bottles 32Y to 32K are upwardly arranged slightly inclining from the horizon in this order. The Y to K toner in the toner bottles 32Y to 32K are replenished by the later mentioned toner conveyance device to the developing devices of the process units 6Y to 6K, respectively. These, the toner bottles 32Y to 32K are separately detachable to the printer body.

In this printer, a contact condition of the photo-conductive member to the intermediate transfer belt 8 is differentiated in accordance with a mode, such as a monochrome mode in which a monochrome image is formed, a color mode in which a color image is formed, etc. Specifically, only the K use primary transfer bias roller 9K is supported by a private use bracket, not shown, separated from other color uses. Whereas the Y to M use primary transfer bias rollers 9Y to 9M are commonly supported by a moving bracket, not shown. The moving bracket is moved by a solenoid, not shown, either to approach or deviate from the Y to M use photoconductive members 1Y to 1M. When the moving bracket is moved to deviate from the Y to M use photoconductive members 1Y to 1M, a suspension posture of the intermediate transfer belt 8 changes and the intermediate transfer belt 8 is separated from the three Y to M use photoconductive members 1Y to 1M. However, the K use photoconductive member 1K keeps contacting the intermediate transfer belt 8. In this way, in a monochrome mode, image formation is executed while only the K use photoconductive member 1K keeps contacting the intermediate transfer belt 8. At this moment, among these four photoconductive members, only the K use 1K is driven rotated while remaining Y to M use photoconductive members 1Y to 1M are stopped driving.

When the above-mentioned moving bracket is moved toward the three photoconductive members 1Y to 1M, a suspension posture of the intermediate transfer belt 8 changes and comes to contact the three photoconductive members. At this moment, the K use photoconductive member 1K continuously contacts the intermediate transfer belt 8. In this way, in the color mode, image formation is executed while all of the four photoconductive members 1Y to 1K all contact the intermediate transfer belt 8. In such a system, the moving bracket or the above-mentioned solenoid function as a contact/separation device that causes the photoconductive member to either contact or separate from the intermediate transfer belt 8.

The printer includes a main control section, not shown, that controls driving of the four process units 6Y to 6K and the optical writing unit 7 or the like. The main control section includes a CPU (Central Processing Unit) serving as a calculation device, a RAM (Random Access Memory) serving as a data storage, and a ROM (Read Only Memory) serving as a data storage or the like, and controls the process units and optical writing unit based on program stored in the ROM.

Separate from the main control section, there is provided a driving control section, not shown. The driving control section controls driving of the later mentioned common drive motor and a photoconductive member motor based on program stored in the ROM.

Figure 3:
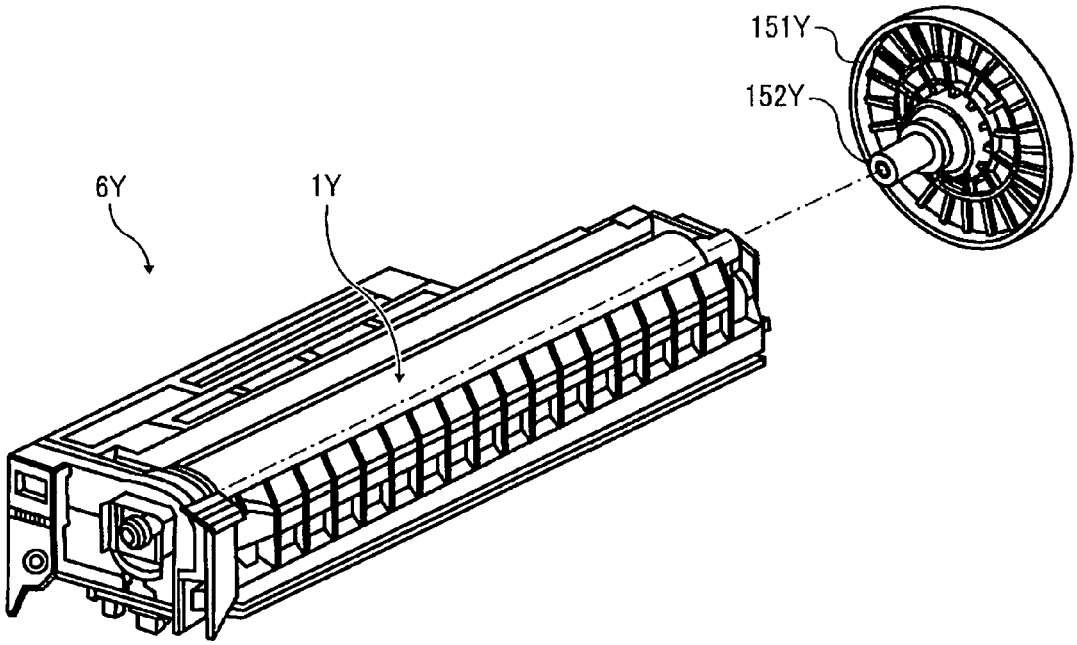
FIG. 3 illustrates an exemplary photoconductive member gear for Y component color use secured to a printer body and the Y use process unit.

Now, an exemplary Y use process unit 6Y and a Y use photoconductive member gear 151 secured to the printer body are described with reference to FIG. 3. As shown, the photoconductive member gear 151Y is rotatably supported in the printer body. The process unit 6Y is detachable to the printer body. The photoconductive member 1Y of the process unit 6Y includes a cylindrical drum section, a shaft member protruding from both end thereof in a rotation axis direction out of a unit casing. To the shaft member arranged on the rear side in the drawing, not shown, a well-known coupling is secured. At a rotation center of the photoconductive member gear 151Y on the printer body side, a coupling section 152Y is formed. The coupling section 152Y is engaged with the coupling secured to the shaft member of the photoconductive member 1Y. With the engagement, a rotation driving force of the photoconductive member gear 151Y is transmitted to the photoconductive member 1Y via the coupling engagement section.

When the process unit 6Y is drawn from the printer body, engagement of the coupling section 152Y with the coupling secured to the shaft member of the photoconductive member 1Y is released. Such engagement and disengagement are similarly executed in the other process units employing the different component colors.

When a photoconductive member gear 151Y includes eccentricity, the photoconductive member 1Y causes velocity fluctuation showing one cycle of a sine curve per rotation.

Now, a distinguishing configuration of one embodiment is described with reference to FIGS. 4 and 5. As shown, with a photo-conductive member gear 151K of the K use photo-conductive member 1K, a motor gear 160*a* of the common driving motor 160 serving as a common driving source meshes. The common driving motor 160 includes a DC brush less motor, or a stepping motor or the like which has an excellent constant velocity performance.

A driving force transmitted from the motor gear 160*a* of the common driving motor 160 to the K use photo-conductive member gear 151K is further transmitted to the M use photo-conductive member gear 151M via a first relay gear 161. The driving force transmitted to the M use photoconductive member gear 151M is further transmitted to the C use photocondudtive member gear 151C via a second relay gear 162. Further, the driving force transmitted to the C use photoconductive member gear 151C is further transmitted to the Y use photoconductive member gear 151Y via a third relay gear 163. Thus, since the driving force is sequentially transmitted, one common driving motor 160 can drive and rotate the four photoconductive members.

With the K use photoconductive member gear 151K, the fourth relay gear 161 meshes beside the first relay and motor gears 161 and 160*a*. The driving force transmitted to the fourth relay gear 164 from the photoconductive member gear 151K is further transmitted to the driving roller gear 167 via the fifth relay and the concentric gears 165 and 166 in order. The driving roller gear 167 is secured to a rotation shaft member of the driving roller 12 that endlessly drives the intermediate transfer belt 8, and thus integrally rotates with the driving roller 12.

Due to transmission of the driving force generated by the common drive motor 160 in this manner, the intermediate transfer belt 8 is endlessly rotated. The fifth rely and concentric gears 165 and 166 are integral and rotate together at prescribed deviated positions in the rotation axial direction.

The various relay gears preferably employ an electromagnetic clutch to either convey or interrupt rotation-driving force from the common drive motor 160. For example, by interrupting the transmission of the driving force to the downstream with the first relay gear 161 in the monochrome mode for forming a monochrome image, the K use photoconductive member 1K can be driven while stopping the Y to C use photoconductive members 1Y to 1C.

There is provided a mark 153 at a prescribed position in a circumferential direction of the K use photoconductive member gear 151K to detect a mark 153 for ref angle detection use.

Further, on the left side of the photo-conductive member gear 151K in the drawing, there is provided a mark detection sensor 154 that detects the mark 153 when the photo-conductive member gear 151K takes a posture at a prescribed rotation angle using an optical tech. Specifically, by detecting the mark 153 with the mark detection sensor 154, it is recognized that the photoconductive member gear 151K takes the posture of the prescribed rotation angle.

The drive control section 250 outputs a prescribed drive current to the common drive motor 160. A DC brushless motor (e.g. a DC servo motor) including a built-in velocity sensor that detects a rotation angular velocity of a motor shaft is employed in this embodiment. The DC brushless motor includes a coil of a three-phase (U, V, and W) star line connection type and a rotor.

Three hall elements are connected to the drive control section 250 via its outputs to detect a position of the rotor by detecting a magnetic pole of the rotor. When the DC servo motor including a built-in MR sensor is employed, a magnetic pattern formed on the periphery of the rotor and the MR sensor are provided as a rotational velocity detection section (i.e., a velocity information detection section), and output terminals thereof are connected to the drive control section 250. The drive control section 250 includes three high and low side transistors connected to respective coils of U, V, and W. Specifically, in accordance with a rotor positional signal generated from the hall element, a phase switching signal is generated. The phase switching signal turns on and off the respective transistors of the drive control section 250, and rotates the rotor by switching phases to excite in turn.

Further, the drive control section 250 compares rotational velocity information detected by the velocity sensor with prescribed target rotational velocity information, and generates and outputs a PWM signal, so that a detected rotational velocity of the motor shaft becomes the target rotational velocity. A PWM signal is superimposed with the phase switching signal by an AND gate circuit, so that driving current is chopped. As a chopping device, a known PLL control circuit system that compares an output pulse signal of the velocity sensor with the prescribed target rotational velocity information is exemplified. A target rotational velocity information acquiring device is employed and applies frequency modulation based on a prescribed target rotational velocity of a photoconductive member and outputs a pulse signal to correct a fluctuation component of a rotational velocity of one rotational cycle.

Further, the target rotational velocity information-processing device can include a digital circuit than the analog one. If digital processing is executed, a frequency of a wave form outputted from the velocity sensor is detected to calculate a rotation angular velocity. Otherwise, numbers of pulses outputted from the velocity sensor is counted to figure out the rotation angular velocity. Further, when a rotation angular change rather than the rotation angular velocity is detected and controlled, numbers of pulses outputted from the velocity sensor is counted and the rotation angular change amount is preferably calculated. Then, a difference from target data that is sent from the control target value output section is calculated, and the common drive motor 160 is driven to decrease the difference. In general, the drive control section 250 employs a PID control device or the like to process signals to suppress deviation, overshoot, vibration or the like, and outputs a PWM signal to the driving pulse generation section to meet the target rotational velocity.

Now, an exemplary control sequence executed by cooperation of the main control and driving control sections is described with reference to FIG. 6. As shown, it is determined if a valid motor driving velocity fluctuation pattern is stored in step S1. If the control sequence has been executed in the past, the valid motor driving velocity fluctuation pattern has already been stored in a memory of the like. The motor driving velocity fluctuation pattern is updated based on detection of a pattern image mentioned later in detail when one of a photoconductive member and a transfer unit 15 is replaced or detached, and when peripherals of a drive transmission system are repaired or replaced. Thus, just after the shipping from a factory, or the replacement of the photoconductive member or the transfer unit 15, the valid motor driving velocity fluctuation pattern is not stored, and thus steps of from S2 to S7 are practiced. When the valid motor driving velocity fluctuation pattern is stored (Yes, in step S1), only steps of from S8 to S9 are practiced based on the same.

When the valid motor driving velocity fluctuation pattern is not stored, a pattern image is detected and a motor driving velocity fluctuation pattern is created in the steps of from S2 to S7.

Figure 7:
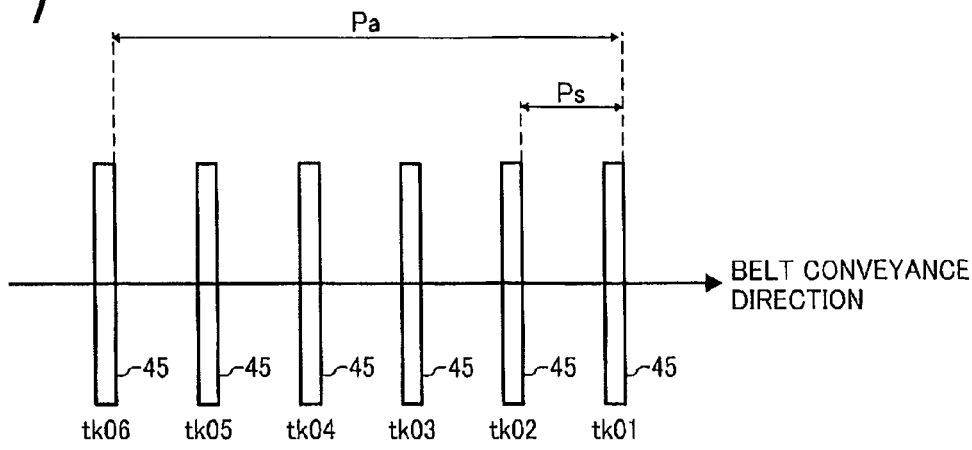
FIG. 7 schematically illustrates an exemplary pattern image formed on an intermediate transfer belt according to one embodiment of the present invention.

Specifically, to initially detect an expansion and contraction pattern of an image which is generated by a velocity fluctuation pattern of a sine curve in one rotational cycle of the photoconductive member 1K, a pattern image is formed on the photoconductive member 1K and is transferred onto the intermediate transfer belt 8 in step S2. Then, plural patch images constituting the pattern image are each detected by a pattern sensor 90 that includes an optical sensor serving as an image detecting device in step S3 as shown in the pattern image includes plural patch images arranged in a ladder state in the sub scanning direction on the intermediate transfer belt 10 as shown in FIG. 7. Respective intervals between the patch images fluctuate in accordance with velocity fluctuation of the photoconductive member 1K in a sine curve, which is caused by the eccentricity of the photoconductive member gear 151K. A time when the mark detection sensor 154 detects a mark 153 on the photoconductive member gear 151K and that when each of the respective patch images is detected are stored.

Among the detection results in the step S3, a fluctuation component of a patch image detection time interval caused by the velocity fluctuation of the intermediate transfer belt 8 is included beside that caused by the velocity fluctuation of the photo-conductive member 1K due to the eccentricity of the photo-conductive member gear. Then, only the fluctuation component of the velocity of the photoconductive member 1K forming the sine curve is extracted in step S4. Then, it is determined if an error of patch image detection time interval is included in the extracted component of velocity fluctuation pattern when the patches are detected. This represents that an error occurs between a patch image detection time interval and a patch distance interval due to occurrence of velocity fluctuation of the intermediate transfer belt 8 during the patch detection. Specifically, when the error exists, accordingly the velocity of the intermediate transfer belt 8 fluctuates (Yes, in step S5), a velocity fluctuation pattern detected at the time is corrected to remove the error in step S6.

Heretofore, an expansion and contraction pattern (i.e., amplitude and a phase of a sine curve) appearing on an image transferred on the intermediate transfer belt 8 in one rotational cycle of the photo-conductive member 1K can be obtained. Then, based on the expansion and contraction pattern, a motor driving velocity fluctuation pattern capable of canceling the expansion and contraction pattern is calculated in step S7. Specifically, the motor driving velocity fluctuation pattern can cancel an expansion and contraction pattern of an image caused by velocity fluctuation of the photo-conductive member 1K due to eccentricity of the photo-conductive member gear using a prescribed latent image expansion and contraction pattern obtained at the latent image writing position by intentionally fluctuating a line speed of the photoconductive member 1K (i.e., superimposing of an expansion and contraction pattern of a latent image at an exposure point SP with that of an image appearing at a transfer point TP). When the motor driving velocity fluctuation pattern is established, the driving speed of the common drive motor 160 is finely controlled based on both the motor driving velocity fluctuation pattern and an output from the mark detection sensor 154 that reflects a rotation angular posture of the photoconductive member 1K in the subsequent printing jobs in steps S8 and S9.

Through the experience, it has been revealed that in a system in which a common drive motor 160 drives both of a photo-conductive member 1K and an intermediate transfer belt 8, image expansion and contraction is only created by a fluctuation of a rotational velocity of the common drive motor 160 at an exposure point SP (not the transfer point TP). Specifically, when the driving velocity of the common drive motor 160 is fluctuated, line speeds of the photoconductive member 1K and intermediate transfer belt 8 fluctuate, respectively, by the same amount in accordance with the former fluctuation. Thus, even though, the driving velocity of the common drive motor 160 is intentionally fluctuated, line speeds of the photoconductive member 1K and the intermediate transfer belt 8 do not become different from each other. Thus, image expansion and contraction is only caused by the above-mentioned intentional fluctuation at the exposure point SP where a latent image is written. Thus, by driving the common drive motor 160 using a prescribed driving velocity pattern capable of canceling an expansion and contraction pattern of an image created by velocity fluctuation of the photo-conductive member 1K due to eccentricity of the photo-conductive member gear using a latent image expansion and contraction pattern by creating intentionally fluctuating driving velocity of the common drive motor 160, an image on an intermediate transfer belt 8 is not expanded and contracted finally.

Now, respective steps of a control sequence are described with reference to FIG. 6. In step S1, a pattern image is formed on a surface of any one of the photoconductive members while driving the common drive motor 160 at a prescribed constant speed, and is then transferred onto the intermediate transfer belt 8 as shown in FIG. 7. The pattern image includes plural patch images of one of component colors Y to K arranged in the sub scanning direction (i.e., the surface moving direction of the photo-conductive member) at a prescribed pitch. The respective toner images 45 have rectangular shape extending in the main scan direction (i.e., the axis direction of the photo-conductive member) as shown. The pattern sensor 90 detects the plural patch images 45 of the pattern image in turn, and time period tk01 to tk0*n* elapsing from a prescribed reference time are obtained.

Since influence from the belt velocity fluctuation caused by eccentricity of the driving roller 12 needs to be corrected, a length Pa of the pattern image in the belt moving direction is integer number times of a perimeter length of the driving roller 12. Further, since influence of the belt velocity fluctuation of a sine curve per circulation of the intermediate transfer belt 8 caused by a difference of a thickness thereof created in centrifugal molding is to be corrected, a length Pa of the pattern image in the belt moving direction is integer number times of a perimeter length of the belt. In the patch image detection time interval detected by the pattern sensor 90, a component caused by the velocity fluctuation of the photoconductive member, that of the belt caused in a rotational cycle of the driving roller, and that of the belt caused in a cycle of the belt are superimposed. Thus, the velocity fluctuation of the photoconductive member needs to be highly precisely detected separately from others. Then, the interval Ps is set relatively short so as to thicken the pattern. However, the patch interval Ps is practically determined based on an available minimum pattern width and a calculation time period or the like.

For example, when a component of the belt velocity fluctuation in one rotational cycle of the driving roller 12 is to be corrected, a sampling pattern length Pa is determined considering a rotational cycle of the driving roller 12. When diameters of the photo-conductive member and the driving roller 12 are 40 mm and 30 mm, respectively, rotational cycles of the photo-conductive member and driving roller 12 converted into surface moving distances of the intermediate transfer belt 8 become 125.7 mm and 94.2 mm, respectively. Then, these common multiplier, such as the least one 377 mm, etc., is designated as the sampling pattern length Pa. A patch interval Ps is designated to be the same with the other in the sampling pattern length Pa. As a result, both of the fluctuation components of the belt velocity fluctuations in one rotational cycle of the photoconductive member and the driving roller 12 can be highly precisely detected. Further, when the belt velocity fluctuation caused by fluctuation of the thickness of the intermediate transfer belt 8 in a winding direction is to be corrected, the least common multiplier of 377 mm is designated as the pattern length closest to one circuit of the belt so that the cyclic velocity fluctuation of the intermediate transfer belt is highly precisely detected.

A fluctuation component occurring in a cycle more than ten times than one cycle of the photo-conductive member, such as a rotational cycle of the common drive motor 160 that serves as a driving source of the driving roller 12, etc., can be removed by applying digital processing to detection data using a low pass filter.

Figure 9:
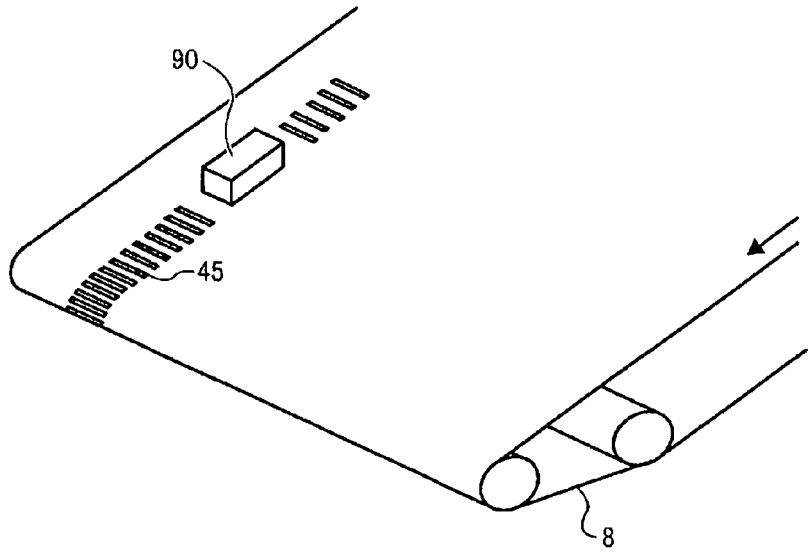
FIG. 9 illustrates an exemplary pattern sensor and an intermediate transfer belt according to one embodiment of the present invention.

An exemplary pattern sensor 90 and an intermediate transfer belt 8 are now described with reference to FIG. 9. As shown, the pattern sensor 90 is arranged above the intermediate transfer belt 8 to detect patch images of a pattern image formed on belt widthwise ends of an image area thereon in step S3. The pattern sensor 90 includes an LED element serving as an illumination use light source, a light sensitive element that receives a reflection light, and a pair of condenser lenses (not shown). The LED element has prescribed light intensity capable of generating necessary reflection light for detecting patch images 45 in the pattern image formed on the intermediate transfer belt 8. Further, the light sensitive element is arranged adjacent to a position where a light reflected from the patch images 45 on the intermediate transfer belt 8 enters via the condensing lens, and includes a number of light acceptance pixels aligned as a line type light sensitive element.

Figure 10:
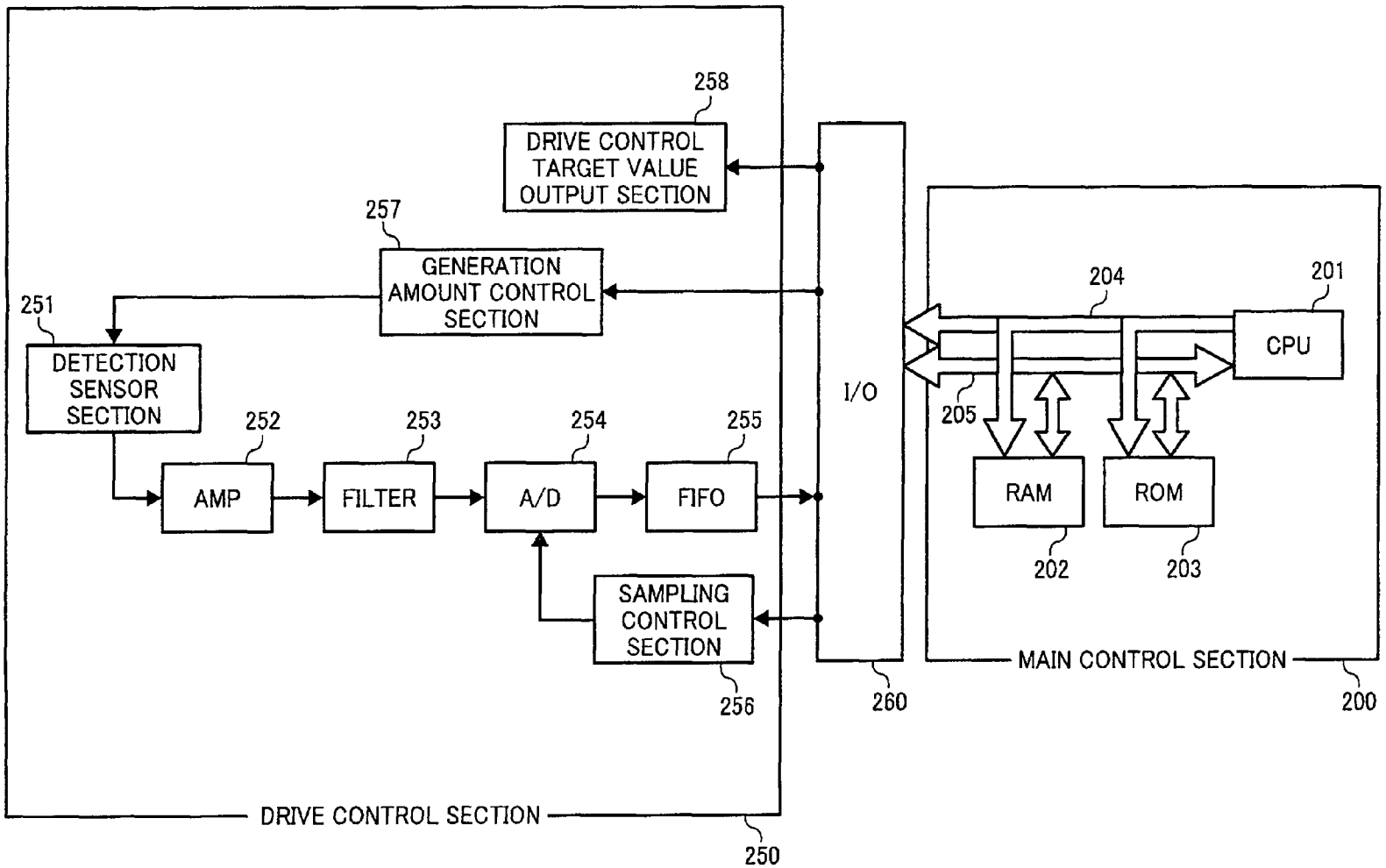
FIG. 10 illustrates exemplary structures of the main control and drive control sections of FIG. 6.

Now, an exemplary main control section 200 and a drive control section 250 are described with reference to FIG. 10. Signals obtained by the detection sensor section 51 including a pattern sensor 90 of FIG. 9 are amplified by the AMP 252, and only components corresponding to the detection signals of the pattern images of FIG. 7 pass through the filter 253. The signals passing through the filter 253 are converted into a digital state from an analog state by the A/D converter 254. A sampling control section 256 controls sampling of the data. The sampled data is then stored in a FIFO memory 255. When detection of the pattern images is completed, the data stored in the memory are transmitted to the main control section 200 from the drive control section 250 via an I/O port 260. The data transmitted to the drive control section 250 are loaded on the CPU 201 and the RAM 202 by a data bus 205 in the main control section 200. Then, the CPU 201 executes calculation to obtain a fluctuation amount of correction targets as mentioned above.

The CPU 201 monitors a detection signal transmitted from the detection section 251 at a prescribed time. The CPU 201 adjusts light intensity using a light intensity control section 257 to precisely detect patch images 45 in a pattern image so that a signal level of the light outputted from the light sensitive element of the detection sensor section 251 is constant even when the intermediate transfer belt 8 and the LED element of the pattern sensor of the detection sensor 251 deteriorate.

In the ROM 203, various items of programs, such as that for calculating various fluctuation amounts, etc., are stored. Further, an address bus 204 designates addresses of a ROM and a RAM and various input/output instruments. When each of the patch images 45 of the pattern image is detected, the CPU 201 outputs instructions to each section at a prescribed time, such as a time when a mark detection sensor 154 detects a mark 153 of FIG. 4 on the photo-conductive member gear 151K, etc. Thus, image data of the pattern image stored in the ROM 203 is read, and optical writing for forming a pattern image is executed for any one of mono colors. These operations are executed in the same manner as in a normal mode of a printing job. Thus, one of the process units of a color forms and transfers a pattern image from a surface of the photoconductive member onto an intermediate transfer belt 8. A result of detecting the each of respective patch images 45 of the pattern image with the detection sensor section 251 is stored in the FIFO 255 converted by the AD converter 254 as mentioned above in a sampling cycle designated by the sampling control section 256. The data in the FIFO 255 includes a numeral value of an output signal in accordance with a pattern reflection light intensity received by the light sensitive element of the pattern detection sensor 90. The numeral value changes in accordance with toner color and density of toner of the patch image 45. The printer does not execute the pattern detection with reference to a prescribed threshold, but executes pattern passage detection by means of a peak recognizing system of a numeral value.

In step S3, data (hereinafter referred to as pattern detection data) obtained in this way representing patch image detection time interval is stored in the RAM 202. These pattern detection data include a time interval fluctuation component caused by velocity fluctuation of the photo-conductive member in one rotational cycle, that caused by the eccentricity of the driving roller 12 in one rotational cycle, and that caused by the unevenness of the thickness of the intermediate transfer belt 8 in one rotational cycle. Then, the printer of this embodiment detects amplitude and a phase of the respective fluctuation components. As one of such detection manners, it can be exemplified that an average of entire data is supposed to be zero, and amplitude and a phase of the fluctuation component are detected based on a zero cross point or a peak value of a fluctuation value. However, usage of such a manner is impractical for calculating plural fluctuation components based on the detection data. Then, the printer calculates amplitude and a phase of a fluctuation component generated in a rotational cycle of a correction target by applying quadrate detection data processing to pattern detection data.

Among the various time interval fluctuation components detected by the system of step S4, time interval fluctuation components generated in one rotational cycle of the driving roller 12 and the intermediate transfer belt 8 can be removed if the following manners are employed. Specifically, amplitude and phase data of the respective fluctuation components generated in one rotational cycle of the driving roller 12 and the intermediate transfer belt 8 and calculated based on the pattern detection data include not only patch interval fluctuation caused by a line velocity difference between the photoconductive member and belt during a transfer process from the photoconductive drum to the intermediate transfer belt 8, but also a detection error of the pattern sensor that detects a patch interval due to (its performance in accordance with) a belt velocity fluctuation at a detection position where the pattern sensor 90 detects the patch image 45.

Figure 4:
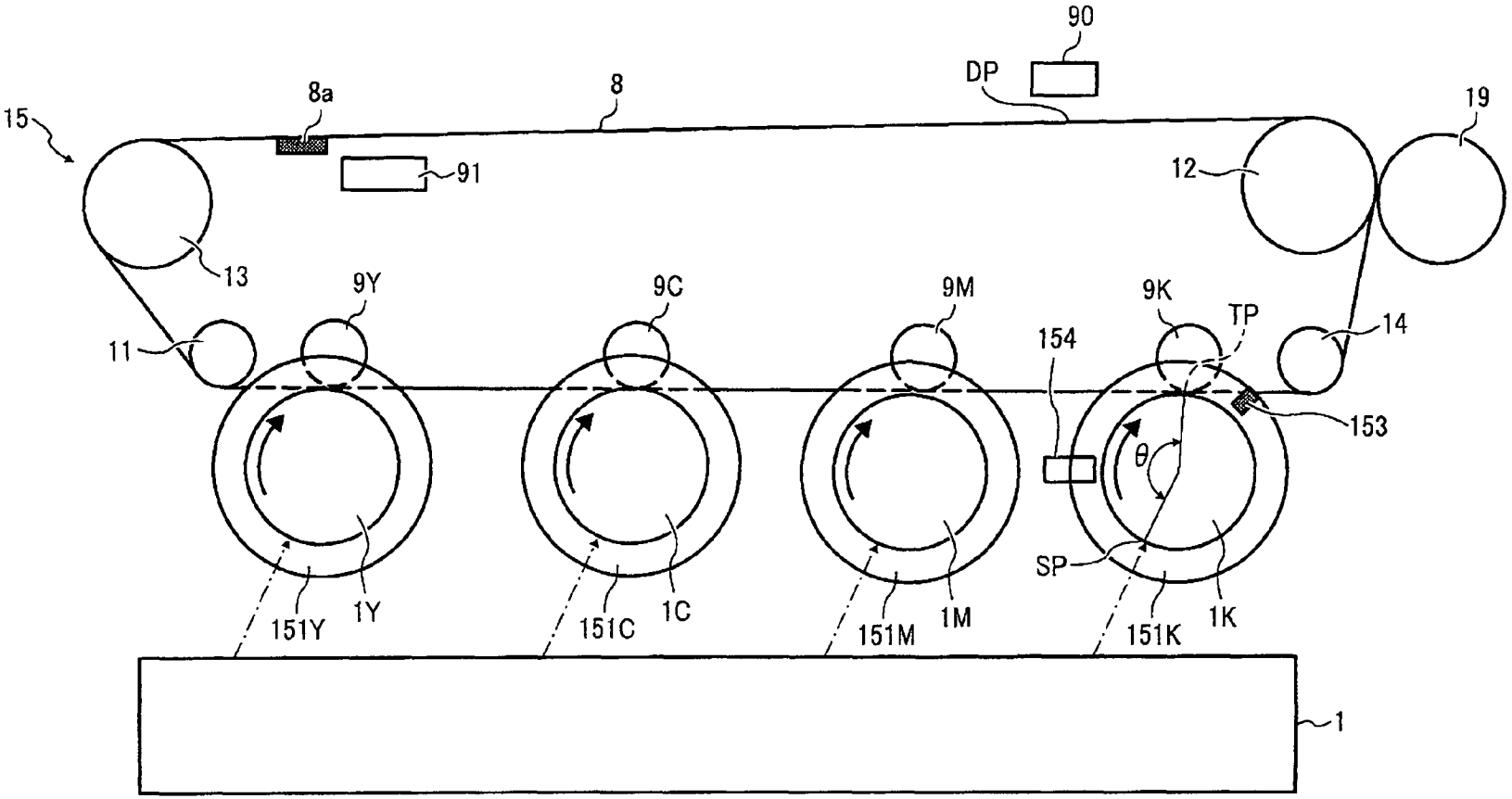
FIG. 4 illustrates an exemplary transfer unit and a driving transmission system each provided in the printer.
Figure 5:
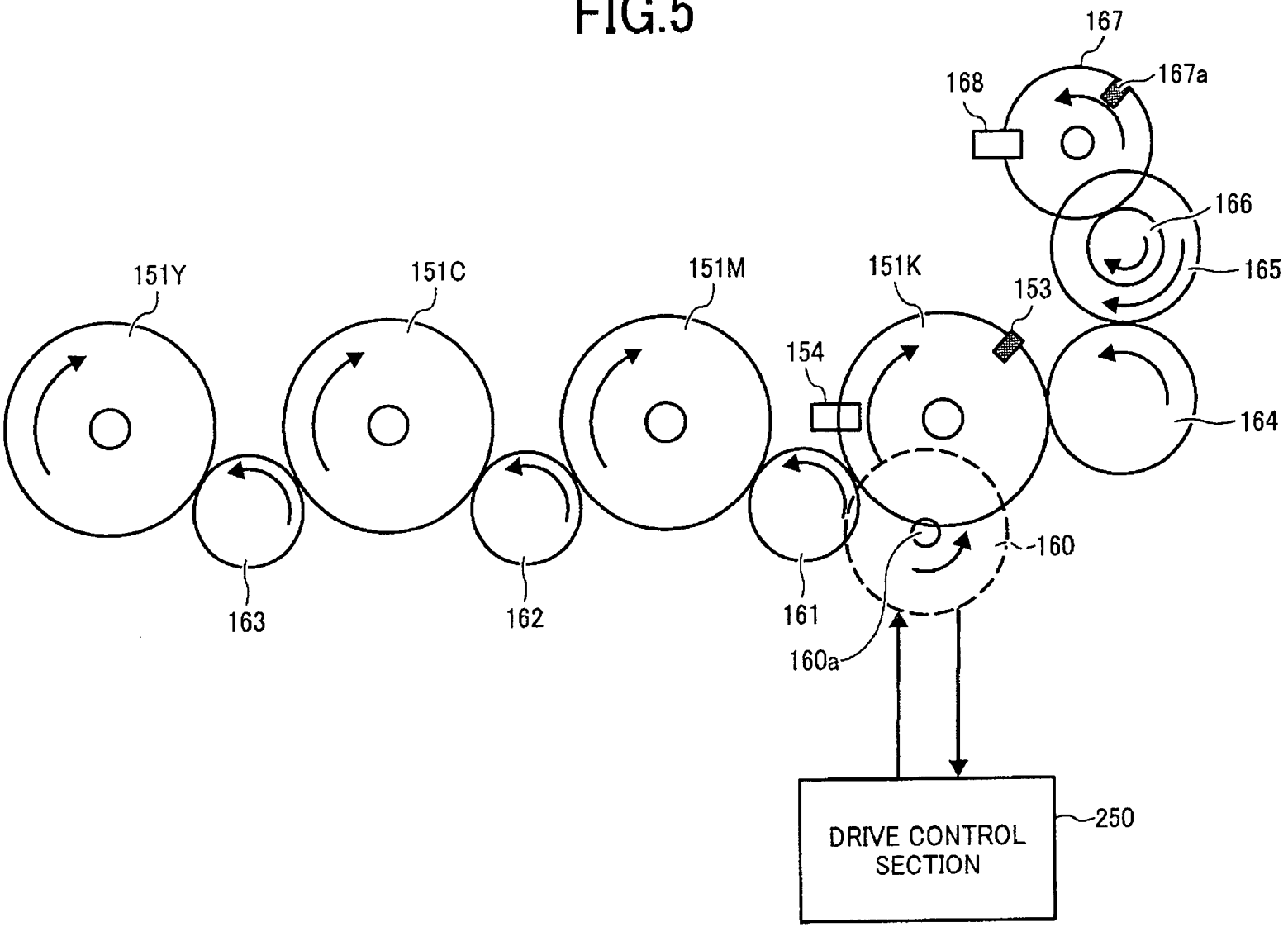
FIG. 5 illustrates the driving transmission system of FIG. 4.

Now, with reference to a transfer point TP on the peripheral surface of the photoconductive member and a detection point DP of FIG. 4 where the pattern sensor 90 detects a patch image, a relation between an amount of fluctuation of the patch detection time interval between patches on the intermediate transfer belt by the driving roller 12 and the intermediate transfer belt 8 in one rotational cycle of those, and a detection error of the patch detection time interval caused in accordance with the belt velocity fluctuation at the detection point DP is described. Also described is a manner of appropriately finding a pattern fluctuation amount from pattern fluctuation data obtained based on the above-mentioned pattern detection data by correcting a detection error caused when detecting a patch detection time interval. Even though formation of a black pattern image on a photoconductive member 1K is typically described, that of the other color patterns can be employed.

Figure 6:
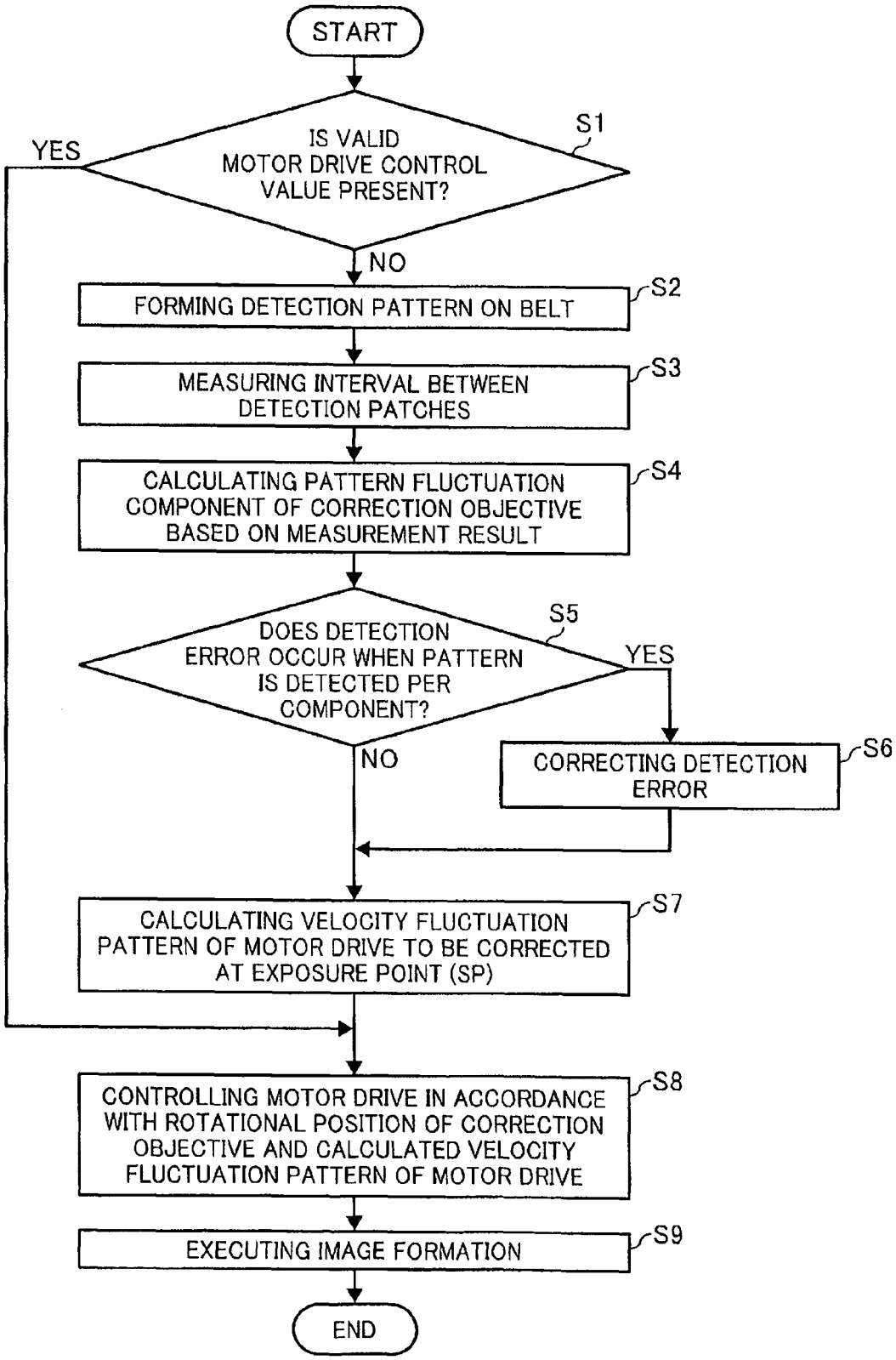
FIG. 6 illustrates an exemplary control sequence implemented by a combination of main control and drive control sections included in the printer.

In step S2 of FIG. 6, a latent image of patch images is written on a surface of the photo-conductive member 1K at a prescribed time interval. A belt velocity VbT of an intermediate transfer belt, including velocity fluctuation in one rotational cycle of the driving roller 12 caused when a pattern image is transferred from the photo-conductive member 1K to the intermediate transfer belt 8 is calculated by the formula 1 as shown in FIG. 19, wherein Vb0 represents an average velocity of the intermediate transfer belt 8, delta Vb represents an amplitude of the velocity fluctuation of the transfer belt that occurs in one rotational cycle of the driving roller 12, ω b0 represents an angular velocity of the driving roller 12, and a b represents an initial phase of belt velocity fluctuation at the time t=0, i.e., when a leading patch image of a pattern image is transferred onto an intermediate transfer belt 8.

A time td0 when a second mark detection sensor 168 detects a mark 167*a* put on the driving roller gear 167 that rotates together with the driving roller 12 is stored in a memory to be used to finely adjust a driving velocity of a common drive motor 160 based on a motor driving velocity fluctuation pattern.

Further, two patch images optionally formed on the photoconductive member 1K at a very small time interval δ t arrives at a transfer point TP keeping the same time interval with each other. However, a patch interval on the intermediate transfer belt 8 fluctuates being affected by a belt velocity. Specifically, the faster than an average the intermediate transfer belt 8, the wider the interval of the patches. In contrast, the slower the intermediate transfer belt 8 than the average, the narrower the patch interval. The patch interval δ P0 including the fluctuation amount is calculated by the formula 2.

In step S5, a patch interval in a pattern image transferred onto the intermediate transfer belt 8 is detected when a time T ϕ needed for the belt to move from the transfer point TP to the detection point DP has elapsed. Specifically, during the above-mentioned time period, the driving roller 12 rotates by a phase angle ϕ d. Since the phase angle ϕ d is different per process unit, respective correction values can be calculated by substituting each of phase angles ϕ dy to ϕ dk of Y to K patterns in the formula. A belt velocity VbD is calculated by the formula 3 as illustrated in FIG. 19 when a patch interval is to be detected.

As shown, a fluctuation includes a phase angle ϕ d representing elapse of the time T ϕ in relation to the belt velocity at the transfer point TP. When a time period when the pattern on the belt passes through the detection point DP is detected, and the belt speed is faster than the average, the patch interval is detected as being narrower, while wider when slower, each as the detection error as mentioned earlier. The patch interval δ P is calculated by the formula 4 as illustrated in FIG. 19 when the pattern image 45 on the belt is to be detected by the pattern detection sensor 90, wherein the following equality is met:

$$Pn=Vb0\delta t$$

Since being sufficiently smaller than the average velocity Vb0, the belt velocity fluctuation component delta Vb can approximate the formula 5 as illustrated in FIG. 19. The first term in the bracket represents a fluctuation amount of the patch interval on the belt, and the second term represents a detection error amount in the formula. Such a formula can be converted into the formula 6 as illustrated in FIG. 19.

As shown, the sixth formula represents a patch interval including an amount of error detected by the pattern detection sensor 90 after two patch images formed at a prescribed interval of a very small time period δ t are transferred onto the intermediate transfer belt 8.

Thus, according to the above-mentioned analysis, a relation between the patch interval on the belt in the formula 2 and a result of detection of those are revealed. Based on the relation between the detection result and the formula 2, a relation between fluctuation of the patch interval on the belt caused by the fluctuation of the belt velocity in one rotational cycle of the driving roller 12 and detected amplitude and phase of the fluctuation is represented by formulas 7 and 8 as illustrated in FIG. 19.

From these formulas, it is recognized that due to the detection error during the patch detection, the amplitude of the fluctuation component of the patch interval on the belt is detected with a change of 2× sin(ϕ d/2) times and the phase thereof with that of +ϕ d/2−π/2 radian, respectively. Thus, a fluctuation amount of the patch interval on the belt is calculated considering the changes. Further, the belt velocity fluctuation occurring in one rotational cycle of the intermediate transfer belt 8 is calculated using the same correction manner while substituting each of phase angles ϕ b (ϕ by to ϕ bc) in accordance with a distance from the transfer point Tp to the detection point DP.

A motor driving velocity fluctuation pattern capable of canceling a patch interval fluctuation in step S7 is calculated as follows. Initially, the common drive motor 160 drives the photo-conductive member 1K and the intermediate transfer belt 8, and a relation between rotation fluctuation of the common drive motor 160 and a fluctuation amount of the patch interval occurring on the intermediate transfer belt 8 due to motor rotation fluctuation is derived. Then, the driving velocity fluctuation pattern capable of canceling the patch interval fluctuation on the belt caused by rotation fluctuation of correction objectives is analyzed.

In FIG. 4, it is supposed that an angular velocity ω m of the common drive motor 160 is represented by the formula 9 with reference to a time when the mark detection sensor 154 detects the mark 153 of the photo-conductive member gear 151Y, wherein an angular velocity ω m0 represents an average of the common drive motor 160. Further, delta ω m1 represents amplitude of the rotational velocity fluctuation of the common drive motor 160, ω m1 represents an angular velocity of a rotational velocity fluctuation component, and α m1 represents an initial phase of a fluctuation component of a detection reference of the mark detection sensor 154.

In the formula 9, delta $\omega_{m1}$ cos(ω m1*t*+αm) of the second term of the right-hand side thereof represents a component of a rotation angular velocity fluctuation that appears at an optional rotation angular velocity $\omega_{m1}$ when a time t has elapsed after the time when the mark detection sensor 154 detects the mark 153.

Specifically, the term represents an amount of a fluctuation of rotation angular velocity for correcting a patch fluctuation caused by one of velocity fluctuations of the photo-conductive member 1K, the driving roller 12, and the intermediate transfer belt 8 each in one rotational cycle as a correction objective. In this printer, since there are three correction objectives, respective fluctuation components of rotation angular velocities $\omega_{m2}$ and $\omega_{m3}$ are superimposed on the third and fourth, terms in the right-hand side of formula 9, when driving control is executed. However, to avoid redundant description, only one fluctuation component is typically described hereinafter. A surface moving velocity Vdm of the photo-conductive member 1K at this time is represented by the formula 10 as illustrated in FIG. 19, wherein a deceleration ratio of a rotation shaft in relation to the common drive motor 160 and a radius of the photo-conductive member 1K are represented by Gd and Rd, respectively.

A surface moving velocity Vbm of the intermediate transfer belt 10 at this time is represented by the formula 11 as illustrated in FIG. 19, wherein a ratio of deceleration to the rotation shaft of the driving roller from the drive motor 33 and a belt drive radius of the driving roller 8 including a distance from the surface of the driving roller 12 to an average pitch line of the intermediate transfer belt 10 are represented as Gb and Rb, respectively.

In the system in which the common drive motor 160 drives both of the photo-conductive member 1K and the intermediate transfer belt 8, velocity fluctuations represented by the formulas 10 and 11 simultaneously occur. Due to these velocity fluctuations, a patch interval fluctuates at the exposure and transfer points SP and TP on the photoconductive member 1K, respectively.

Now, amounts of fluctuation of the patch interval appearing at the respective points SP and TP are described. Initially, at the exposure point SP, an interval between optional two patch images to be written at a prescribed very small time interval δ t fluctuates with influence of a velocity fluctuation of the photo-conductive member 1K. Specifically, the faster than an average the photoconductive member 1K, the wider the interval of the patches, and the slower thereof than the average, the narrower the patch interval, respectively. The patch interval including the fluctuation amount thereof is represented by δ Pms as shown in the formula 12.

At the transfer point TP, a patch interval $\delta P_{d0}$ even between ideal two patches formed at a prescribed very small time interval δ t on the photo-conductive member 1K fluctuates with influence of velocity fluctuation of the photo-conductive member and/or intermediate transfer belt caused during a transfer process. Specifically, as a result of the transfer process, the faster than an average velocity the photoconductive member 1K, the narrower the interval of the patches, and the slower thereof than the average velocity, the wider the patch interval, respectively. In contrast, the faster than an average velocity the belt, the wider the interval of the patches, and the slower thereof than the average velocity, the narrower the patch interval, respectively. The patch interval including the fluctuation amount thereof is represented by $\delta P_{mT}$ as shown in the formula 13.

Since being sufficiently smaller than the average velocity $\omega_{m0}$, the velocity fluctuation component delta $\omega_{m1}$ of the common drive motor 160 can approximates the formula 14.

According to this formula, a fluctuation component is cancelled, and only a constant velocity component calculated based on diameters of the photoconductive member and the driving roller, as well as the deceleration ratio remains. Accordingly, it is recognized that fluctuation of a patch interval to be caused by motor rotation fluctuation does not appear at the transfer point TP. Because, even if a motor driving velocity is changed, since the photo-conductive member 1K and the intermediate transfer belt 8 fluctuate their velocities by the same amount in proportion thereto at the transfer point TP, an amount of displacement between the photoconductive member 1K and the intermediate transfer belt 8 during a patch transfer process is not differed from the other by the motor driving velocity fluctuation.

Thus, when driving control is executed so that the common drive motor 160 fluctuates by a rotation angular velocity as shown by the formula 9 in accordance with the above-mentioned analysis, an image having fluctuation of a patch interval as shown by the formula 12 is formed on the intermediate transfer belt 8.

In step S7, to cancel a patch fluctuation component recognized by forming and detecting an interval of patch images, a driving velocity fluctuation pattern of the common drive motor 160 is calculated.

Specifically, to derive a pattern of the driving velocity fluctuation of the common drive motor 160 based on the fluctuation of the patch interval detected, the formula 12 that represents fluctuation of the patch interval caused by fluctuation of the rotation angular velocity of the common drive motor 160 is integrated to obtain practical patch formation time period Te.

Thus, on condition that a cycle of writing of a pattern image is equivalent to the prescribed constant time interval Te, a pattern of the driving velocity fluctuation of the common drive motor 160 can be derived based on the component of the fluctuation of the patch interval detected after transfer thereof onto the belt.

Figure 8:
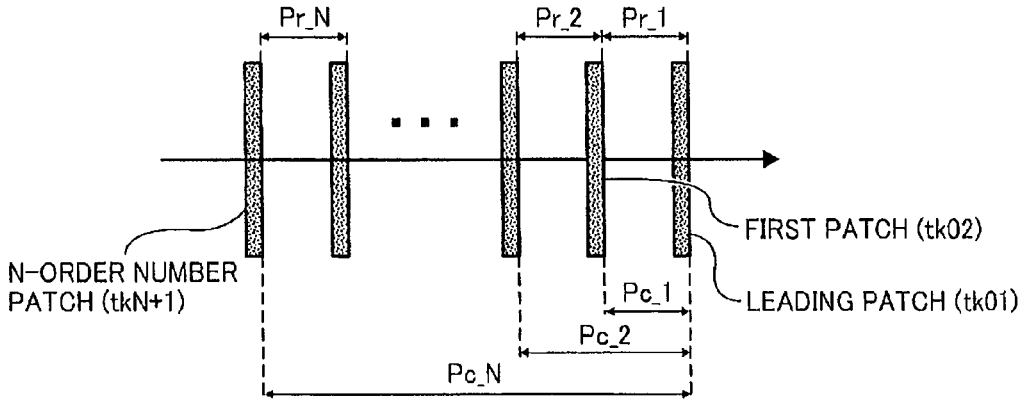
FIG. 8 illustrates an exemplary relation between a position of a patch image in the pattern image and a detection time when the patch image is detected according to one embodiment of the present invention.

As a patch interval detection manner, either an accumulated interval is sometimes detected with reference to a leading patch or a neighboring patch interval is detected. In each of the detection manners, the formula 12 is integrated. Specifically, as shown in FIG. 8, the formula 15 is obtained when an accumulated patch interval Pc-N, which is accumulation up to when a N order number patch written after a time TeN (N represents a natural number) has elapsed from when the leading patch of the pattern image is detected at a time tk01 as a reference (0), wherein the time δ t of the formula 12 represents a prescribed constant time interval Te.

From the formula 15, the formula 16 can be obtained, wherein integration constant C is represented by the formula 17.

Thus, a relation between the driving velocity fluctuation pattern of the common drive motor 160 of formula 9 and an accumulated patch interval o be formed is revealed.

The first term on the right-hand in the formula 16 corresponds to an inclination of patch detection data and represents an entire magnification of an image. The second term on the right-hand in the formula 16 represents an amount of fluctuation of an accumulated patch interval.

In the pattern detection process, when a pattern group written at a prescribed constant time interval Te is detected by the pattern detection sensor 90 on the intermediate transfer belt 8, patch detection data (e.g. time data) is stored in the above-mentioned RAM 202. The CPU 201 converts the detection data of an average of surface moving velocity of the intermediate transfer belt 8 or the photoconductive member to an accumulated patch interval on the intermediate transfer belt 8. An average increase amount of the detection data (i.e., the accumulated interval data) corresponds to the first term on the right-hand of the formula 16, while the fluctuation component, the second term on the right-hand thereof, respectively. Both of amplitude and a phase of a fluctuation component of a sine wave that appears in a rotation angular velocity (ω m1) of a correction objective are calculated by applying the above-mentioned qaudrature detection processing to the pattern fluctuation data. A relation between a reverse value capable of canceling the amplitude $A_{m1}$ and the phase $B_{m1}$ and amplitude delta ω m1 and phase α m1 of driving velocity fluctuation pattern is represented by the formula 18. The third term C on the right-hand in the formula 16 represents a steady deviation that simply biases a zero level of cyclic fluctuation of the second term on the right-hand thereof in an amplification direction. Specifically, the term does not affect amplitude and a phase detected by the quadrature conversion.

The phase Bm1 in the formula 19 serves as a detection reference for the mark detection sensor 154 that detects the mark 153. Specifically, amplitude delta ω m1 and phase α m1 of a component of rotation angular velocity fluctuation of the common drive motor 160 are obtained from the formulas 18 and 19, and a driving velocity fluctuation pattern capable of canceling a component of the rotation angular velocity fluctuation caused during patch detection is then calculated.

As shown in FIG. 8, in steps S8, a neighboring patch interval Pr_N between neighboring patterns of N to N−1 order numbers in N items of patch images 45 written at a time interval Te is represented by the formula 20.

The formula 20 can be converted into formula 21.

Thus, the relation between the driving velocity fluctuation pattern of the common drive motor 160 of formula 9 and the neighboring patch interval to be formed is revealed. The first term on the right-hand in the formula 21 corresponds to an average of patch detection data and represents an average patch interval in an image. The second term on the right-hand of the formula 21 represents a fluctuation amount of neighboring patch interval.

When a patch image group written at a prescribed time interval Te is detected by the pattern detection sensor 90 on the intermediate transfer belt 8 during the detection process of the patch interval, patch detection data (i.e., time data) is stored in the above-mentioned RAM 202. The CPU 201 converts the detection data to a neighboring patch interval on the intermediate transfer belt 8 in accordance with an average value of surface moving velocity of the intermediate transfer belt 8 or the photo-conductive member 1K. The average of the detection data (i.e., neighboring patch interval data) corresponds to the first term of the right-hand in the formula 21, while the fluctuation component, the second term of the right-hand thereof, respectively. Based on the patch interval fluctuation data, amplitude and a phase of a fluctuation component in a cosine wave that appears in a cycle of a rotation angular velocity ω m1 of a correction objective are calculated using the above-mentioned Quadrature Amplitude Modulation process.

A relation between a reverse value capable of canceling the amplitude $A'_{m1}$ and the phase $B'_{m1}$ and amplitude delta ω m1 and phase α m1 of driving velocity fluctuation pattern of the common drive motor 160 is represented by the formulas 22 and 23, wherein the phase Bm1 in the formula 23 represents a reference used when the mark detection sensor 154 detects the mark 153 on the photoconductive member gear 151Y as mentioned above.

In step S8, the CPU 201 of the printer of this embodiment calculates a driving velocity fluctuation pattern of the common drive motor 160 based on a detection signal of each of patches of the pattern image as shown in FIG. 7 based on data of amplitude and phase of a fluctuation component in a rotational cycle of a correction objective. The driving velocity fluctuation pattern corrects a rotational velocity of the common drive motor 160 so that an expansion and contraction pattern of an image appearing in one rotational cycle of the photoconductive member 1K becomes smaller. Such a driving velocity fluctuation pattern is set to a drive control target value output section 258 of FIG. 10. The drive control target value output section 258 outputs a rotational velocity target signal (digital data or a pulse line signal) to a motor driver of the common drive motor 160.

In step S9, the driving velocity of the common drive motor 160 is finely adjusted in accordance with the driving velocity fluctuation pattern. At that moment, an image is formed suppressing the expansion and contraction pattern in one cycle of the photoconductive member 1.

Further, a secondary transfer of a toner image from a belt onto a print sheet P is executed in a secondary transfer nip in which a secondary transfer bias roller 19 contacts the intermediate transfer belt 8 in this printer. Similar to the primary transfer executed from the photo-conductive member to the intermediate transfer belt 8, the secondary transfer from the intermediate transfer belt 8 to the printing sheet P causes image expansion and contraction in the secondary transfer nip in accordance with a difference of a line speed between the intermediate transfer belt 8 and the printing sheet P. The line speed difference is caused because the secondary bias roller 19 includes a private use driving source and rotates at a prescribed velocity regardless of velocity fluctuation of the intermediate transfer belt 8. In such a situation, a line speed difference occurs between the printing sheet P and the intermediate transfer belt 8, because the printing sheet P tightly contacts and is conveyed by the secondary transfer bias roller 19, so that the image expands and contracts. In contrast, when a secondary transfer bias roller 19 is a type driven by the driving roller 12 while opposing and pressing thereagainst, the secondary transfer bias roller 19 is moved and follows the printing sheet P in the second transfer nip. Thus, since the printing sheet P in the nip moves following the belt due to friction between itself and toner or the belt, line speeds of the printing sheet P and the secondary transfer bias roller 19 are equivalent, so that an image does not expand or contract therein even if the belt velocity fluctuates. Accordingly, the secondary transfer bias roller 19 is preferably the driven type. Never the less, when the second transfer bias roller 19 includes the private use driving source, its velocity preferably is controlled to accord with velocity fluctuation of the intermediate transfer belt.

The respective photoconductive member gears 151Y to 151K are assembled in prescribed rotational postures so that their phases of rotational velocity fluctuations caused by the eccentricity can be synchronized with each other. Since the respective photoconductive member gears are produced by the same molding system, an amount of eccentricity is the same to each other. Thus, the respective photoconductive member gears provide velocity fluctuation patterns of the same amplitude in one circuit with each other. Further, since the respective photo-conductive member gears are assembled to synchronize their phases of velocity fluctuation patterns with each other, image distortions generally caused by velocity fluctuations of the photo-conductive members in one cycle can be suppressed in each of component color processes other than that of K color.

When a relay gear having a clutch and a system not to transmit a driving force to photoconductive members other than that of K component color in a monochrome mode, the following control is preferably executed. Specifically, marks are attached to positions on the respective photoconductive member gears 151Y to 151K to synchronize their phases of velocity fluctuation patterns caused by the eccentricity of those with each other. In addition, plural mark detection sensors are arranged to separately detect the respective marks on the respective photoconductive member gears 151Y to 151K. Further, in a color mode, color image formation starts when the respective mark detection sensors come to detect the marks at same time, accordingly their rotation phases of the component colors Y to M are adjusted.

Now, various modifications of the printer are described hereinafter, in which the same printer as mentioned above is basically employed with some exception. Initially, a first modification is described. There is another distortion of an image than that caused by an expansion and contraction pattern created by the eccentricity of the photoconductive member gear in one cycle of a photoconductive member. Specifically, the other distortion can be caused by an eccentricity of a drive roller for driving the intermediate transfer belt 8 in a sine curve state in one rotational cycle of the drive roller on the intermediate transfer belt 8. Then, in the first modification of the printer, rather than the image distortion caused by velocity fluctuation of a photo-conductive member in one cycle thereof which is caused by eccentricity of the photoconductive member gear, that caused by velocity fluctuation of a belt in one cycle of the drive roller 12 caused by the eccentricity thereof is enabled to be suppressed. Specifically, in accordance with a result of detection of respective patch images of the above-mentioned pattern image, an expansion and contraction pattern of an image caused by the belt velocity fluctuation is recognized. Then, a pattern of fluctuation of driving velocity of the common drive motor 160 is obtained, which pattern generates an expansion and contraction pattern of a latent image to be written at the exposure point SP so as to cancel that caused by the belt velocity fluctuation.

There is provided a belt mark 167*a* at a prescribed position in a circumferential direction of the driving roller gear 167 of the driving roller 12 to detect a reference angle. Further, on the left side of the driving roller gear 167 in the drawing, there is provided a second mark detection sensor 168 that detects the mark 167*a* when the driving roller gear 167 takes a posture at a prescribed rotation angle using a prescribed optical technology. Specifically, when the mark 167*a* is detected by the second mark detection sensor 168, it is recognized that the driving roller gear 167K takes the posture of the prescribed rotation angle.

To execute a normal mode of a printing job, a latent image expansion and contraction pattern capable of canceling the expansion and contraction pattern of the image at the exposure point SP is created by finely adjusting a driving velocity of the common driving motor 160 based on the above-mentioned driving velocity fluctuation pattern and a time when the second mark sensor 168 detects the mark 167*a*.

Further, a latent image expansion and contraction pattern capable of canceling, at the exposure point SP, both of image distortion caused by fluctuation of the velocity of the photoconductive member (of a sine curve in a one rotational cycle thereof which is) created by the eccentricity of the photoconductive member gear, and that caused by fluctuation of the velocity of the belt (of a sine curve in a one cycle of the driving roller which is) created by the eccentricity thereof can be generated.

In such a situation, the rotational cycle of the driving roller 12 is preferably integer number times of the rotational cycle of the photoconductive member.

Now, a second exemplary modification is described. Some distortion of an image is caused by unevenness of the thickness of the intermediate transfer belt 8 in the circumferential direction in one cycle thereof in a state of sine curve. In the second modification, rather than the image distortion caused by velocity fluctuation of a photo-conductive member in one cycle thereof which is caused by eccentricity of the photoconductive member gear, that caused by velocity fluctuation of a belt in one cycle thereof which is caused by the unevenness of the thickness thereof is enabled to be suppressed. Specifically, in accordance with a result of detection of respective patch images of the above-mentioned pattern image, an expansion and contraction pattern of an image caused by the belt velocity fluctuation is initially recognized.

Then, a pattern of fluctuation of driving velocity of the common drive motor 160 is obtained, which pattern generates an expansion and contraction pattern of a latent image written at the exposure point SP to cancel that caused by the belt velocity fluctuation.

On the backside of the intermediate transfer belt 8, there is provided a belt mark 8*a* at a prescribed position in a circumferential direction. Inside the loop of the intermediate transfer belt 8, there is provided a belt mark sensor 91 that detects the mark 8*a* at a prescribed position when the intermediate transfer belt 8 takes a prescribed posture.

To execute a printer job, a latent image expansion and contraction pattern capable of canceling the expansion and contraction pattern of the image at the exposure point SP is created by finely adjusting a driving velocity of the common driving motor 160 based on the above-mentioned driving velocity fluctuation pattern and a time when the belt mark sensor 91 detects the belt mark 8*a*.

Further, a latent image expansion and contraction pattern capable of canceling both of image distortion caused by fluctuation of the velocity of the photo-conductive member of a sine curve in a one rotational cycle thereof which is caused by the eccentricity of the photo-conductive member gear, and that caused by fluctuation of the velocity of the belt of a sine curve in a one cycle thereof which is caused by the unevenness of the thickness of the belt can be generated at the exposure point SP. In such a situation, the rotational cycle of the photoconductive member is preferably integer number times of the cycle of the belt.

Now, a third exemplary modification is described with reference back to FIG. 1. In the transfer unit 15, it is effective to execute feedback control in order to improve detection precision of fluctuation of the pattern image. For example, as shown in FIG. 1, a rotary encoder is secured to a rotation shaft of the driven roller 14 driven rotated by the intermediate transfer belt 8 as it rotates. Driving velocity of the common drive motor 160 is finely adjusted based on rotation information of a rotation angular velocity outputted from the rotary encoder so that the output becomes a prescribed level. Thus, when velocity fluctuation of the belt is suppressed, expansion and contraction caused by velocity fluctuation of the photoconductive member which is created by eccentricity of the photoconductive member gear can be finely detected.

Further, a velocity sensor is attached to the shaft of the common driving motor 160. The velocity sensor detects a rotation condition of the common drive motor 160, and outputs a detection signal. The detection signal is then fed back to a motor driver included in the drive control section 250, so that the driving velocity can be finely adjusted, and accordingly a rotational velocity of the common drive motor 160 can be stable at a prescribed level. Further, as a velocity sensor of a motor built-in type, a frequency generator (FG) of a printer coil type, a MR sensor, or the like are exemplified.

In the third modification of the printer, when the pattern image is formed and/or detected, a driving velocity of the common drive motor 160 is fed back as mentioned above to omit processing of steps S5 and S6 in FIG. 6. However, in proportion to an amount of suppressing the velocity fluctuation of the belt caused by the drive roller 12, rotation of the photoconductive member drum fluctuates and causes displacement of an image. However, such displacement can be corrected by applying similar processing as applied to the fluctuation component of the photoconductive member 1 in one cycle.

Now, a fourth exemplary modification is described. In the above-mentioned embodiments, the pattern detection sensor 90 includes the LED element as an illumination use light source, the light sensitive element for receiving a reflection light, and a pair of the condensing lenses. However, since the sensor detects a patch passage time period, the sensor is necessarily affected by velocity fluctuation of the belt during the detection thereof. Then, a printer of the fourth modification photographs two neighboring patches using an area type CCD sensor as a pattern detection sensor 90, and directly detects an interval between the neighboring patches. According to such a configuration, the interval between the neighboring patches can be highly precisely detected avoiding ill influence of the belt velocity fluctuation. Thus, steps S5 and S6 of FIG. 6 can be omitted improving precise pattern detection.

Figure 11:
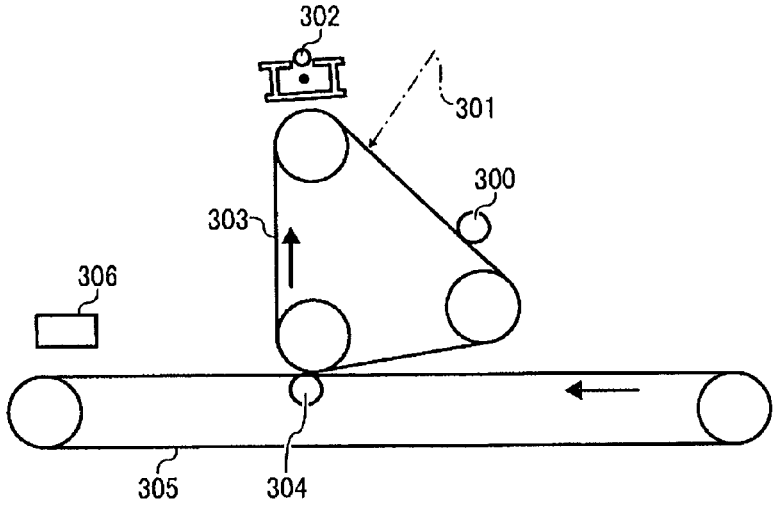
FIG. 11 illustrates an exemplary essential part of the printer according to a fifth modification of the present invention.

Now, a fifth exemplary modification is described with reference to FIG. 11. A printer employs an endless photoconductive belt 303 as a latent image bearer. The photoconductive belt 303 is suspended by three supporting rollers and is driven by one of them in the same direction as the intermediate transfer belt travels. Further, the photo-conductive belt 303 forms a transfer nip by contacting the intermediate transfer belt 305 at a position where the down most roller is arranged winding the belt. Around the photo-conductive belt 303, there are serially provided a charger 302 that charges the photo-conductive belt 303 at a prescribed level, an exposure device that emits a laser light 301 onto the surface of the photoconductive belt 303 carrying the charge in accordance with an image signal, and a developing device 300 that supplies toner with charge to the latent image and develops the same. Also arranged therearound is a transfer roller 304 that transfers the toner image onto the intermediate transfer belt 305.

Further, the transfer roller 304 is arranged inside the loop of the intermediate transfer belt 305 opposing a roller arranged at the lowermost end of the photoconductive belt 303. A pattern sensor 306 detects a pattern image formed on the intermediate transfer belt 305. In such a photoconductive belt 303, due to eccentricity of the drive roller or distribution of thickness deviation, a surface moving velocity of the photoconductive belt 303 fluctuations in one rotational cycle thereof. To correct such fluctuation of the surface moving velocity in one cycle of the photoconductive belt 303 in such a configuration, a pattern of velocity fluctuation of driving of the common drive motor (e.g. a drive motor driving two belts in this situation) that causes a latent image expansion and contraction pattern capable of canceling an expansion and contraction pattern of an image is obtained in accordance with a rotation angular velocity ω ob of the photoconductive belt 303 and a position of an exposure point SP of the laser light 301. The above-mentioned parameters corresponding to a radius R and the rotation angular velocity ω can be designated using a circuit and a surface moving velocity of the photo-conductive belt 303.

According to one embodiment of the present invention, the latent image bearer and a conveyance device can be driven by one common drive heat source while saving cost.

Numerous additional modifications and variations of the present invention are possible in light of the above teachings. It is therefore to be understood that within the scope of the appended claims, the present invention may be practiced otherwise that as specifically described herein.

What is claimed is:

1. An image forming apparatus comprising:

an image information reception device configured to receive image information;

at least one latent image bearer configured to rotate and bear a latent image;

a latent image writing device configured to write the latent image at a prescribed latent image writing position on the surface of the at least one latent image bearer in accordance with the image information;

a developing device configured to developing the latent image and obtain a toner image on the surface;

a transfer device configured to transfer the toner image from the at least one latent image bearer onto a transfer receiving member at a prescribed transfer position;

a conveyance device configured to convey the transfer receiving member in the same direction as the at least one latent image bearer moves at the prescribed transfer position;

an image detector configured to detect expansion and contraction on a pattern image formed and transferred from the at least one latent image bearer onto the transfer receiving member at a pattern image detection position;

a driving source configured to provide a driving force;

a common drive force transmission system configured to transmit the driving force to the at least one latent image bearer and the conveyance device, said common drive transmission system including at least one transmission member;

a rotational position detector configured to detect a rotational position of the at least one transmission member, said at least one transmission member causing fluctuation of a velocity of one of the at least one latent image bearer and the transfer receiving member in a cycle per rotation of the at least one transmission member; and a control device configured to control formation of the pattern image while driving the common drive source at a prescribed velocity, wherein said control device recognizes expansion and contraction of the pattern image based on an output of the image detector, said control device calculating a driving motor velocity cancellation fluctuation pattern for driving the common drive source, said driving motor velocity cancellation pattern creating a latent image expansion and contraction cancellation pattern configured to cancel, at the prescribed latent image writing position, the expansion and contraction of the pattern image detected by the image detecting device, wherein a process of calculating said cancellation patterns is executed except when a print job for forming the toner image is executed in accordance with the image information, wherein said control device controls the common drive source in accordance with the driving motor velocity cancellation pattern, and wherein said latent image expansion and contraction cancellation pattern includes the same amplitude and an opposite phase to the expansion and contraction of the pattern image detected by the image detector.

2. The image forming apparatus as claimed in claim 1, wherein said at least one latent image bearer has a cylindrical shape, wherein said at least one transmission member rotates around an axis of the latent image bearer and transmits the driving force thereto, and wherein one of said at least one transmission member causes the fluctuation of a velocity of the latent image bearer.

3. The image forming apparatus as claimed in claim 2, wherein said transfer member includes an endless belt winding and traveling around the at least one transmission member as the at least one transmission member rotates, wherein said conveyance device conveys one of the endless belt and a printing member carried on the endless belt, and wherein said at least one transmission member causes the fluctuation of a velocity of the endless belt.

4. The image forming apparatus as claimed in claim 3, wherein a pattern of said expansion and contraction of the pattern image is generated on the endless belt in one rotational cycle thereof.

5. The image forming apparatus as claimed in claim 2, wherein said at least one latent image bearer includes;

at least two latent image bearers aligned in a transfer member conveyance direction; and at least two transfer devices configured to transfer and superimpose at least two visualized images from the at least two latent image bearers onto the transfer receiving member, wherein said common driving force transmission system transmits the driving force to all of the at least two latent image bearers, and wherein phases of velocity fluctuation of the at least two latent image bearers are equalized with each other.

6. The image forming apparatus as claimed in claim 5, further comprising a detection error correcting device configured to correct an error of expansion and contraction pattern detection, said error being caused by fluctuation of a conveyance velocity of the transfer receiving member at the pattern image detection position.

7. The image forming apparatus as claimed in claim 3, wherein said at least one transmission member includes a driven roller configured to support the endless belt, said driven roller being driven and rotated by the endless belt as the endless belt rotates, said driven roller causing fluctuation of the endless belt in a cycle per rotation of the driven roller.

8. The image forming apparatus as claimed in claim 5, wherein said pattern image includes at least two patches aligned in a latent image bearer surface moving direction, and wherein said image detector is enabled to detect an interval between the at least two patches.

* * * * *